US009532694B1

(12) United States Patent
Shippen et al.

(10) Patent No.: US 9,532,694 B1
(45) **Date of Patent: *Jan. 3, 2017**

(54) COMBINATION WHISK BROOM WITH SQUEEGEE

(71) Applicant: NELI LLC, Orem, UT (US)

(72) Inventors: Scott M. Shippen, Orem, UT (US); Ben R. Shippen, Orem, UT (US); Stephen R. Shippen, Orem, UT (US); David S. Shippen, Orem, UT (US)

(73) Assignee: Neli LLC, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/955,854

(22) Filed: Dec. 1, 2015

Related U.S. Application Data

(63) Continuation-in-part of application No. 14/149,429, filed on Jan. 7, 2014.

(60) Provisional application No. 62/094,247, filed on Dec. 19, 2014, provisional application No. 61/750,264, filed on Jan. 8, 2013.

(51) Int. Cl.
*A47L 13/52* (2006.01)
*A47L 13/12* (2006.01)
*A46B 5/00* (2006.01)

(52) U.S. Cl.
CPC ..... *A47L 13/12* (2013.01); *A46B 5/0095* (2013.01); *A47L 13/52* (2013.01)

(58) Field of Classification Search
CPC ..... A47L 1/06; A47L 13/11; A47L 13/12; A46B 15/0055
See application file for complete search history.

(56) References Cited

U.S. PATENT DOCUMENTS 898,316 A * 9/1908 Carlson ..... A47L 13/24 15/117
5,207,755 A * 5/1993 Ampian ..... A46B 5/0075 15/144.1
8,904,589 B2 * 12/2014 Santarsiero ..... A47L 13/11 15/105
2002/0184728 A1 * 12/2002 Kortleven ..... A46B 15/0095 15/257.2
2003/0051301 A1 3/2003 Morgan et al.
2007/0234497 A1 10/2007 Lee
(Continued)

OTHER PUBLICATIONS

Cleaningquickie. "Spill Collector by Quickie Manufacturing." YouTube, Jul. 30, 2013. Web. Accessed Dec. 17, 2014. https://www.youtube.com/watch?v=NJakCDTdW9U.

(Continued)

*Primary Examiner* — Shay Karls
(74) *Attorney, Agent, or Firm* — Workman Nydegger

(57) ABSTRACT

A device having the ability to alternate between dry spill and wet spill clean-up by simply rotating the head of the device to either the bristle side, for dry material clean-up, or the rubber squeegee side for wet material clean-up. Located on the handle is a release button coupled to the rotatable coupling by which the head rotates about the handle. When this button is pulled or otherwise selectively activated (e.g., pushed, pressed, etc.) the head will now rotate freely allowing the user to alternate between dry and wet clean-up. In an embodiment, the head may be locked at a variety of angles for side sweeping applications such as inside a cabinet, on top of a work bench, etc.

20 Claims, 32 Drawing Sheets

(56) References Cited

U.S. PATENT DOCUMENTS

| | | | | |
|---|---|---|---|---|
| 2008/0072388 | A1* | 3/2008 | Jones | A46B 5/0075 15/105 |
| 2011/0302735 | A1 | 12/2011 | Santarsiero et al. | |

OTHER PUBLICATIONS

U.S. Appl. No. 14/149,429, filed Jan. 7, 2014, Shippen at al.
U.S. Appl. No. 29/549,310, filed Dec. 21, 2015, Shippen et al.

* cited by examiner

COMBINATION WHISK BROOM WITH SQUEEGEE

CROSS-REFERENCE TO RELATED APPLICATIONS

The present application claims the benefit of U.S. Patent Application Ser. No. 62/094,247, filed Dec. 19, 2014, entitled "COMBINATION WHISK BROOM WITH SQUEEGEE". The present application is also a continuation-in-part of U.S. patent application Ser. No. 14/149,429, filed Jan. 7, 2014, entitled "WHISK BROOM WITH SQUEEGEE", which claims the benefit of U.S. Patent Application Ser. No. 61/750,264, filed Jan. 8, 2013, entitled "WHISK BROOM WITH SQUEEGEE". The disclosure of each of the above applications is herein incorporated by reference in its entirety.

BACKGROUND OF THE INVENTION

1. The Field of the Invention

This invention relates to whisk brooms, squeegees, and related systems.

2. Background and Relevant Art

Whisk brooms and dustpans are common items found in most business and home settings. Whisk brooms and dustpans come in a variety of shapes and sizes. They are used to clean up a variety of dry spill debris only. Often, there is a need to clean up a wet spill, or a spill including both wet and dry components. Existing whisk brooms have limited usefulness in such circumstances.

BRIEF SUMMARY

The present invention provides a product having the ability to alternate between dry spill and wet spill clean-up by simply rotating the head to either the bristle side, for dry material clean-up, or the rubber squeegee side for wet material clean-up. Once rotated to the rubber squeegee side the user may now clean-up wet spills such as paint, oil, milk, a dropped egg, etc. Located on the handle is a release button. When this button is pulled or otherwise selectively activated (e.g., pushed, pressed, etc.) the head containing bristles on one end and a squeegee on the other will now rotate freely allowing the user to alternate between dry and wet clean-up. The whisk broom is used in identical fashion as existing whisk brooms, e.g., by simply sweeping the debris into the dustpan, then emptying the dustpan into the garbage. To use the squeegee to clean-up a wet spill the user rotates the head to the squeegee side, then presses the squeegee to the floor in front of the wet spill and moves (e.g., pulls) the spill into the dustpan. The liquid materials can simply be dumped and rinsed from the dustpan in a sink or basin to empty the dustpan. The squeegee edge of the broom head may be cleaned in similar fashion. The head may be locked at a variety of angles for side sweeping applications such as inside a cabinet or on top of a work bench, etc.

For example, according to an embodiment, a combination whisk broom and squeegee device may comprise an elongate handle, a rotatable head that is rotatably attached to the handle, and a release button disposed on or within the handle. The head includes a whisk broom end with a plurality of whisk broom bristles at one end of the head. The opposite squeegee end of the head includes a squeegee (e.g., a rubber or elastomeric tapered squeegee blade overmolded over the opposite end). The whisk broom end may be used to sweep up dry spills, while the squeegee end may be used to clean up wet spills. The head is rotatably coupled (e.g., snap-fitted) to the handle, so that the head is selectively rotatable and selectively lockable in a desired orientation relative to the handle so as to orient the whisk broom end or the squeegee end in a desired locked orientation for use of a respective end. The release button may be coupled to the snap fit or other rotatable coupling structure of the head to selectively release and selectively lock the rotatable head in a desired orientation relative to the handle.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Introduction

The present invention provides a product having the ability to alternate between dry spill and wet spill clean-up by simply rotating the head to either the bristle side, for dry material clean-up, or the rubber squeegee side for wet material clean-up. Once rotated to the rubber squeegee side the user may clean-up wet spills such as paint, oil, milk, water, a dropped egg, etc. Located on the handle is a release button coupled to the rotatable coupling by which the head rotates about the handle. When this button is pulled or otherwise selectively activated (e.g., pushed, pressed, etc.) the head containing bristles on one end and a squeegee on the other will now rotate freely allowing the user to alternate between dry and wet clean-up. The whisk broom is used in identical fashion as existing whisk brooms, e.g., by simply sweeping the debris into the dustpan, then emptying the dustpan into the garbage. To use the squeegee to clean-up a wet spill the user rotates the head to the squeegee side, then presses the squeegee to the floor in front of the wet spill and moves (e.g., pulls) the spill into the dustpan. The liquid materials can simply be dumped and rinsed from the dustpan in a sink or basin to empty and clean the dustpan. The squeegee edge of the broom head may be cleaned in similar fashion. In an embodiment, the head may be locked at a variety of angles for side sweeping applications such as inside a cabinet, on top of a work bench, etc.

According to an embodiment, a combination whisk broom and squeegee device may comprise an elongate handle, a rotatable head that is rotatably attached to the handle, and a release button disposed on or within the handle. The head includes a whisk broom end with a plurality of whisk broom bristles at one end of the head. The opposite squeegee end of the head includes a squeegee (e.g., a rubber or elastomeric tapered squeegee blade overmolded over the opposite end). The whisk broom end may be used to sweep up dry spills, while the squeegee end may be used to clean up wet spills. The head is rotatably coupled (e.g., snap-fitted) to the handle, so that the head is selectively rotatable and selectively lockable in a desired orientation relative to the handle so as to orient the whisk broom end or the squeegee end in a desired locked orientation for use of the respective end. The release button may be coupled to the snap fit or other rotatable coupling structure of the head to selectively release and selectively lock the rotatable head in a desired orientation relative to the handle.

II. Exemplary Combination Whisk Broom and Squeegee Devices

Figure 1:
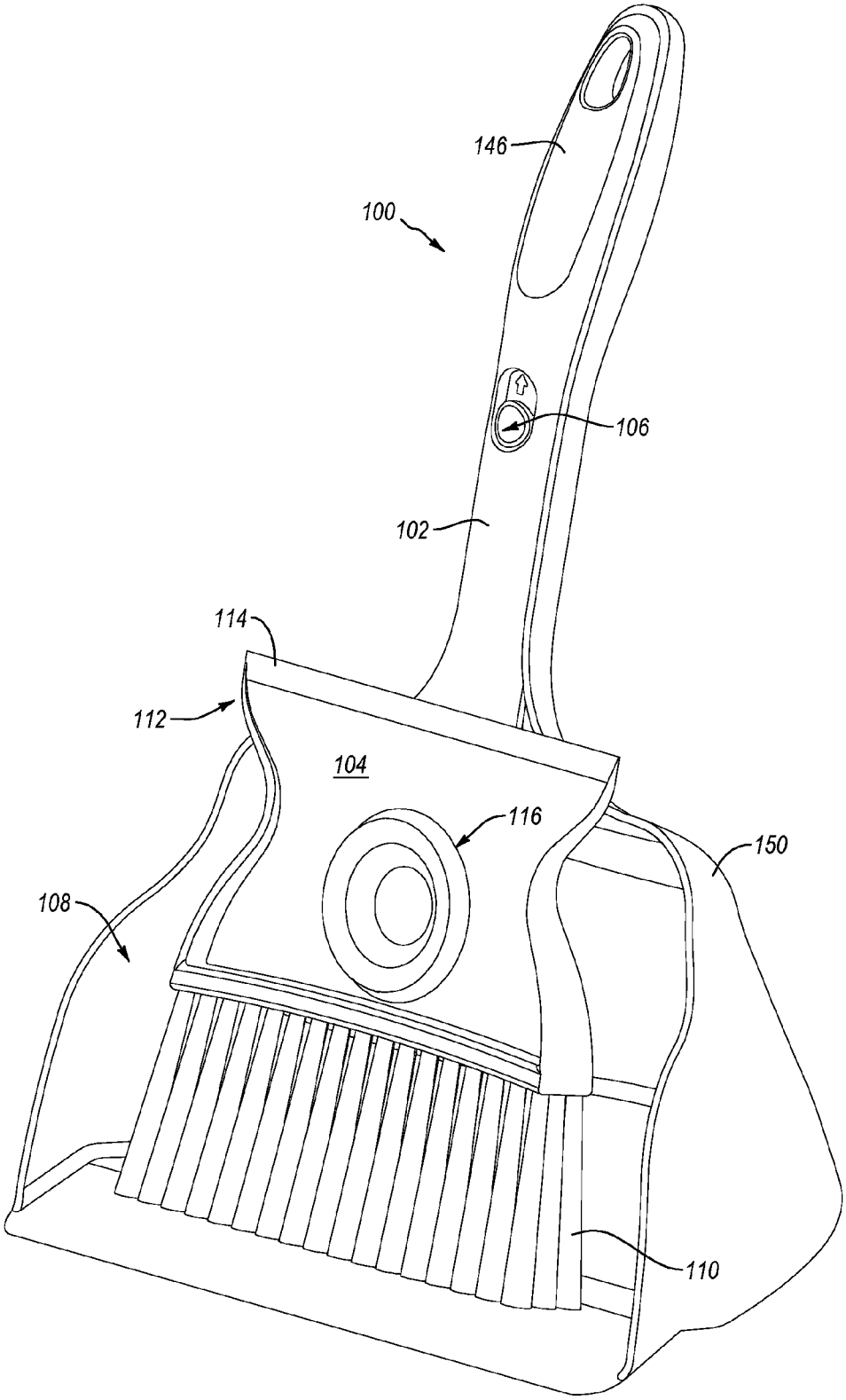
FIG. 1 is an isometric view of an exemplary combination whisk broom with squeegee.

The Figures illustrate an exemplary combination device 100. FIG. 1 shows device 100, in combination with an associated dustpan 150. Combination whisk broom and squeegee device 100 includes an elongate broom or squeegee handle 102, a rotatable head 104, and a release button 106. Head 104 includes a whisk broom end 108, with a plurality of whisk broom bristles 110. Head 104 also includes an opposite squeegee end 112, with a squeegee 114 disposed thereon. Squeegee 114 may comprise a tapered blade of rubber or similar elastomeric material suitable for spreading, pushing, pulling, or wiping liquid from a flat surface. Squeegee 114 may be overmolded over edge 112, or may be secured by any suitable mechanism (e.g., mechanical retention mechanism, adhesive, etc.). Whisk broom bristles 110 may similarly be secured into end 108 by any suitable mechanism (e.g., press fit, secured with adhesive, etc.).

Head 104 is rotatably coupled to handle 102, e.g., at snap fit rotatable coupling 116. Head 104 is selectively rotatable about coupling 116, allowing head 104 to be locked into one of any number of given positions. This allows a user to orient head 104 relative to handle 102 in a desired configuration to employ either the whisk broom end (i.e., bristles 110) or the squeegee end (i.e., squeegee 114) of head 104, as desired.

Figure 2:
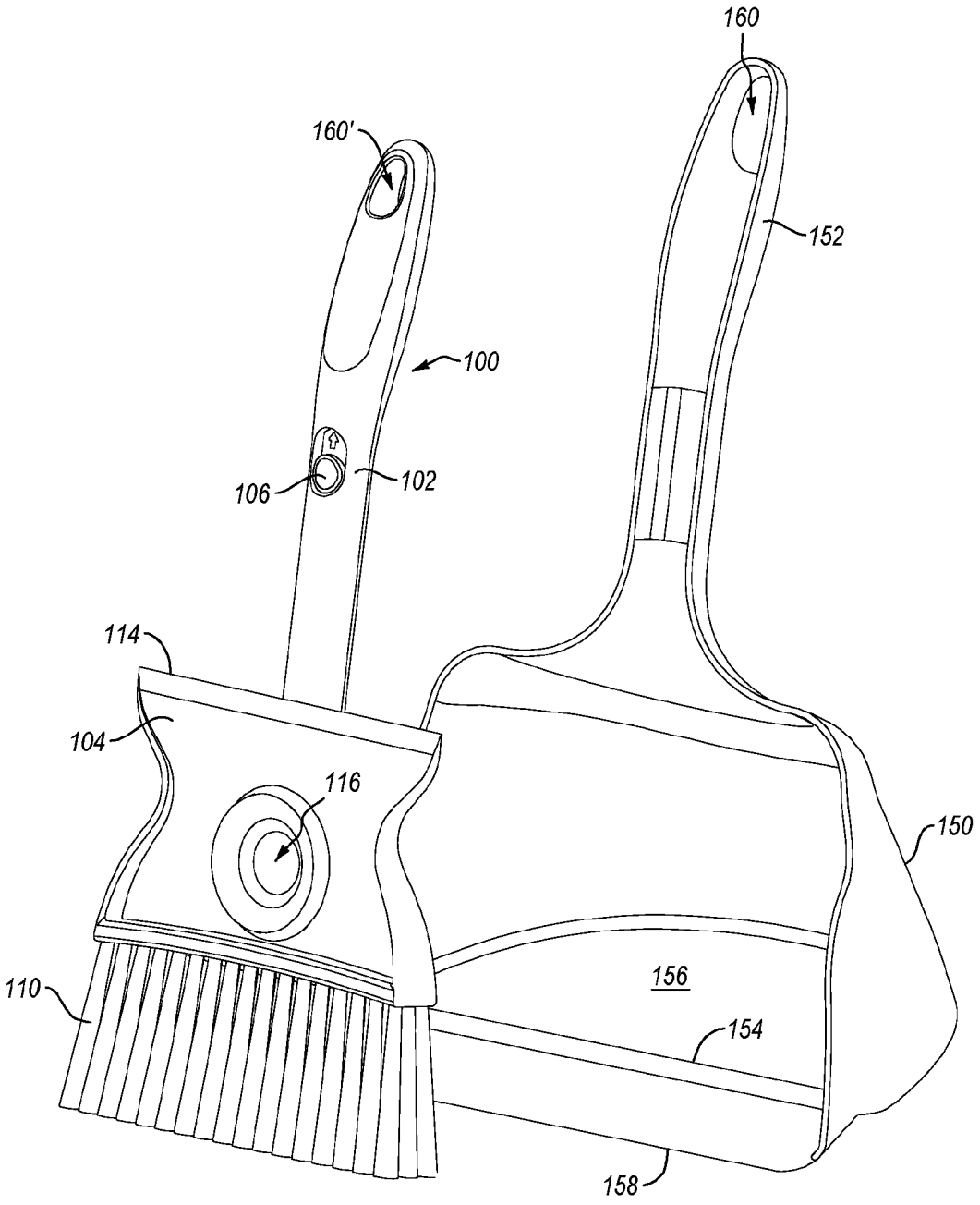
FIG. 2 shows the combination broom with the head rotated in an orientation to sweep dry, solid waste or debris into the associated dustpan.

Release button 106 works with the rotatable coupling 116 to allow selective release of coupling 116, allowing head 104 to rotate freely, followed by relocking head 104 into a desired orientation upon release of button 106, following rotation. FIGS. 1 and 2 show head 104 in an orientation where device 100 is prepared for use as a whisk broom. As shown in FIG. 2, with device 100 separated from dustpan 150, dry debris and other dry waste may be swept into dustpan 150. Dustpan 150 may include an elongate dustpan handle 152 which is hollow and concave along its longitudinal axis (e.g., with a generally U-shaped transverse cross-section), so as to be configured to matingly receive the front or rear surface of handle 102. In other words, hollow handle 152 is correspondingly shaped and sized so as to receive and retain handle 102 of device 100 when handle 102 is pressed into dustpan handle 152, as shown in FIG. 1.

As seen in FIG. 2, dustpan 152 may include an integrated retention dam 154 in bottom surface 156 of dustpan 150, to help retain debris therein. Leading edge 158 of dustpan 150 may further include an overmolded or other elastomeric material edge or blade to help seal dustpan 150 to the floor as materials are guided from the floor over edge 158, over retention dam 154, and down into bottom surface 156 of dustpan 150. Dustpan handle 152 and handle 102 may further each include corresponding and aligned eyelet handing holes 160 and 160', respectively for facilitating hanging of the dustpan 150 and combination device 100 in their coupled configuration (FIG. 1) on a hook.

Figure 3:
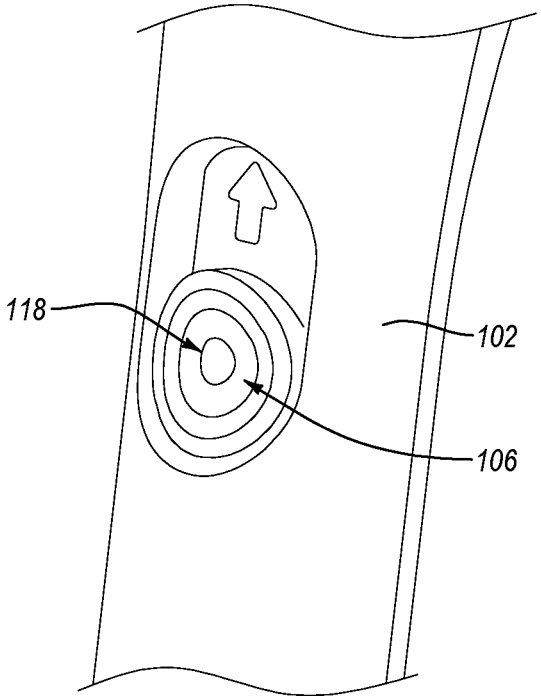
FIG. 3 is a close up view of an exemplary release button on the broom handle.
Figure 4:
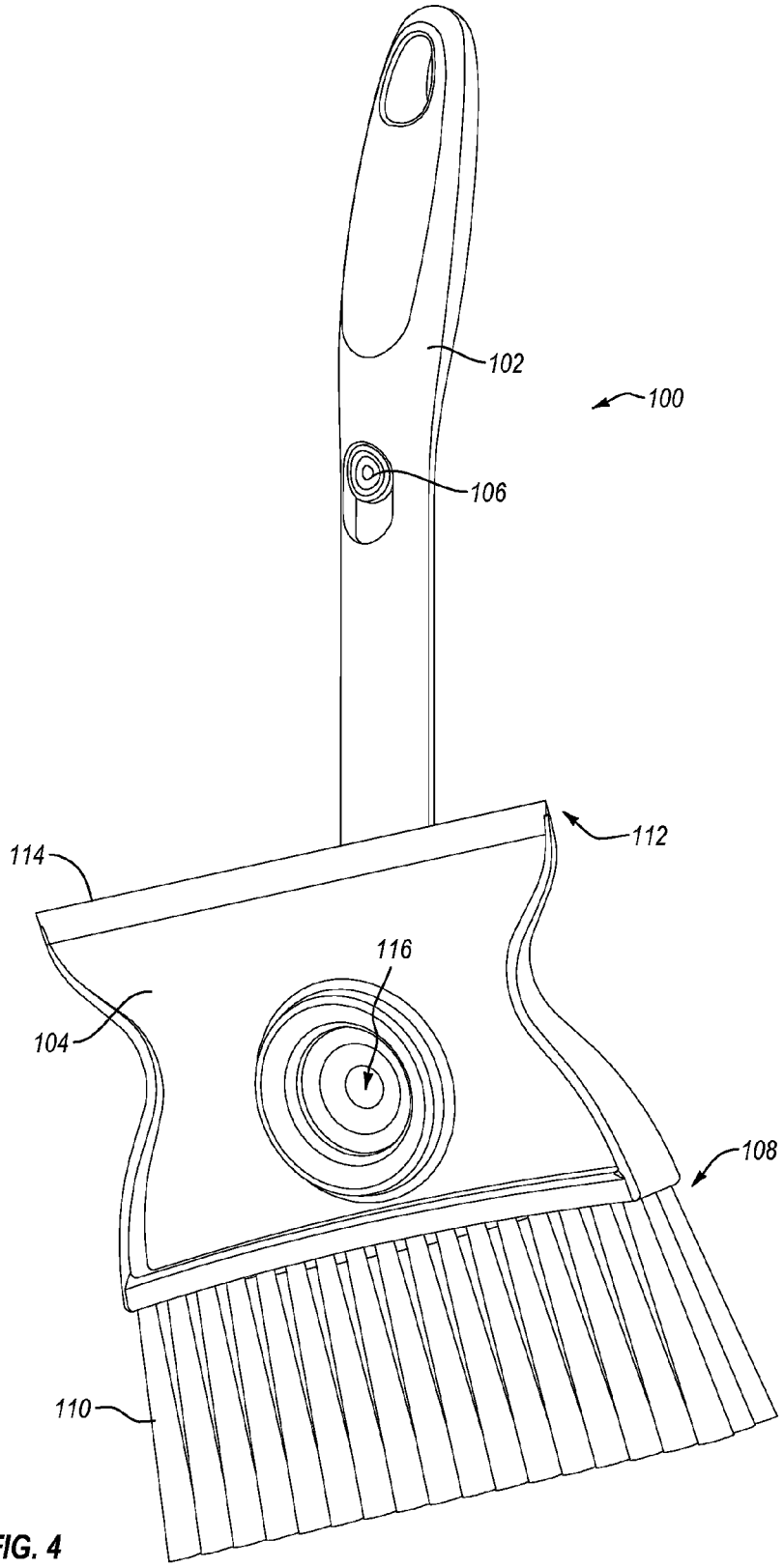
FIG. 4 shows release and rotation of the combination broom and squeegee head.

FIG. 3 shows a close up view of the release button 106. Button 106 may be configured to slide within handle 102. Button 106 may be slidable between a first position (e.g., as seen in FIGS. 1-3) corresponding to a locked configuration, where head 104 is locked against rotation. When release button 106 is slid to a second position (e.g., slid up), as seen in FIG. 4, head 104 is unlocked, and becomes freely rotatable about coupling 116. As seen in FIG. 3, release button 106 may include a finger recess (e.g., a smooth concave curved recess) 118, allowing a user to easily insert a finger and pull button 106 upwards.

Figure 5A:
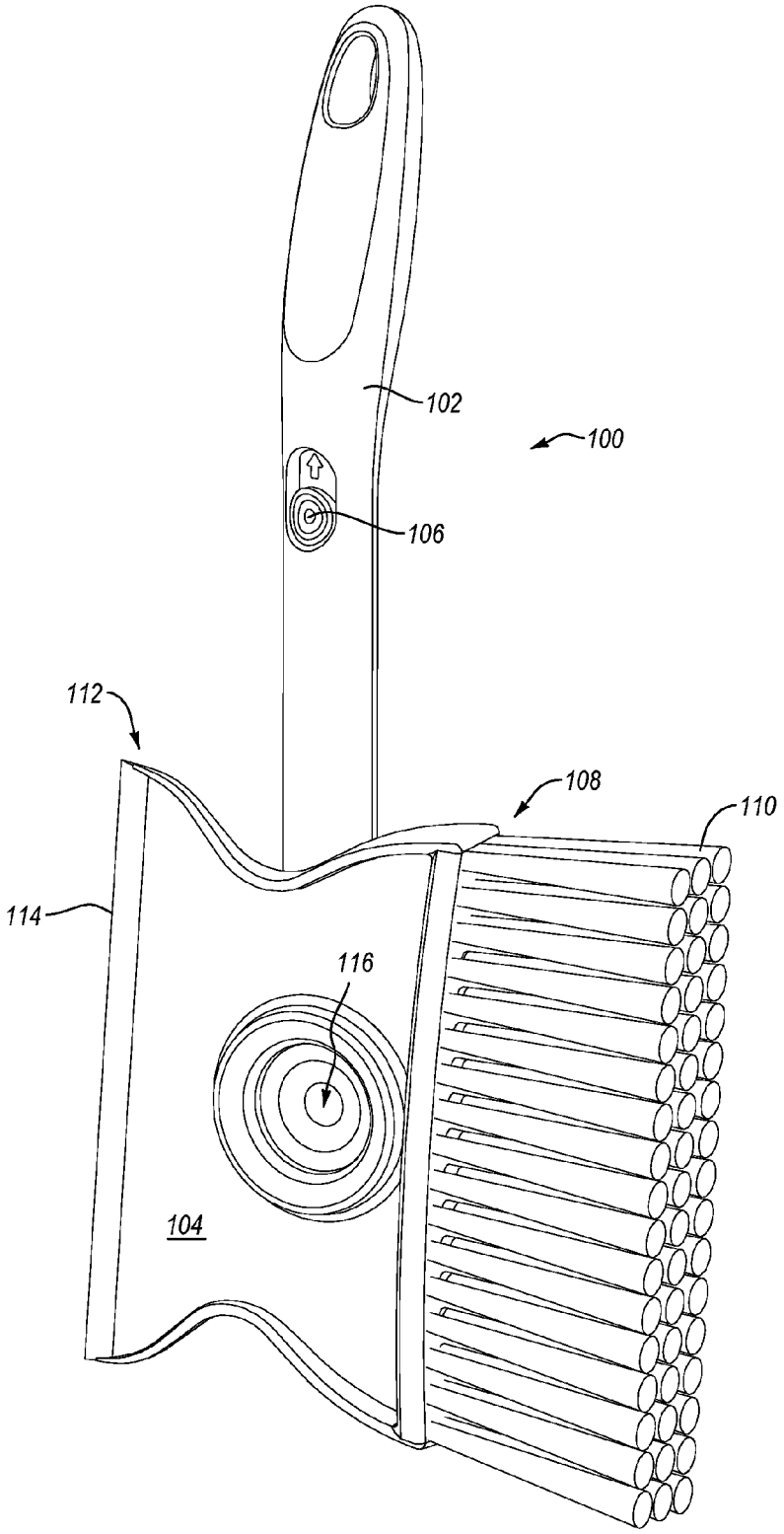
FIG. 5A shows rotation of the broom bristles to a selected angle of 90° relative to the "bristles down" configuration.
Figure 5B:
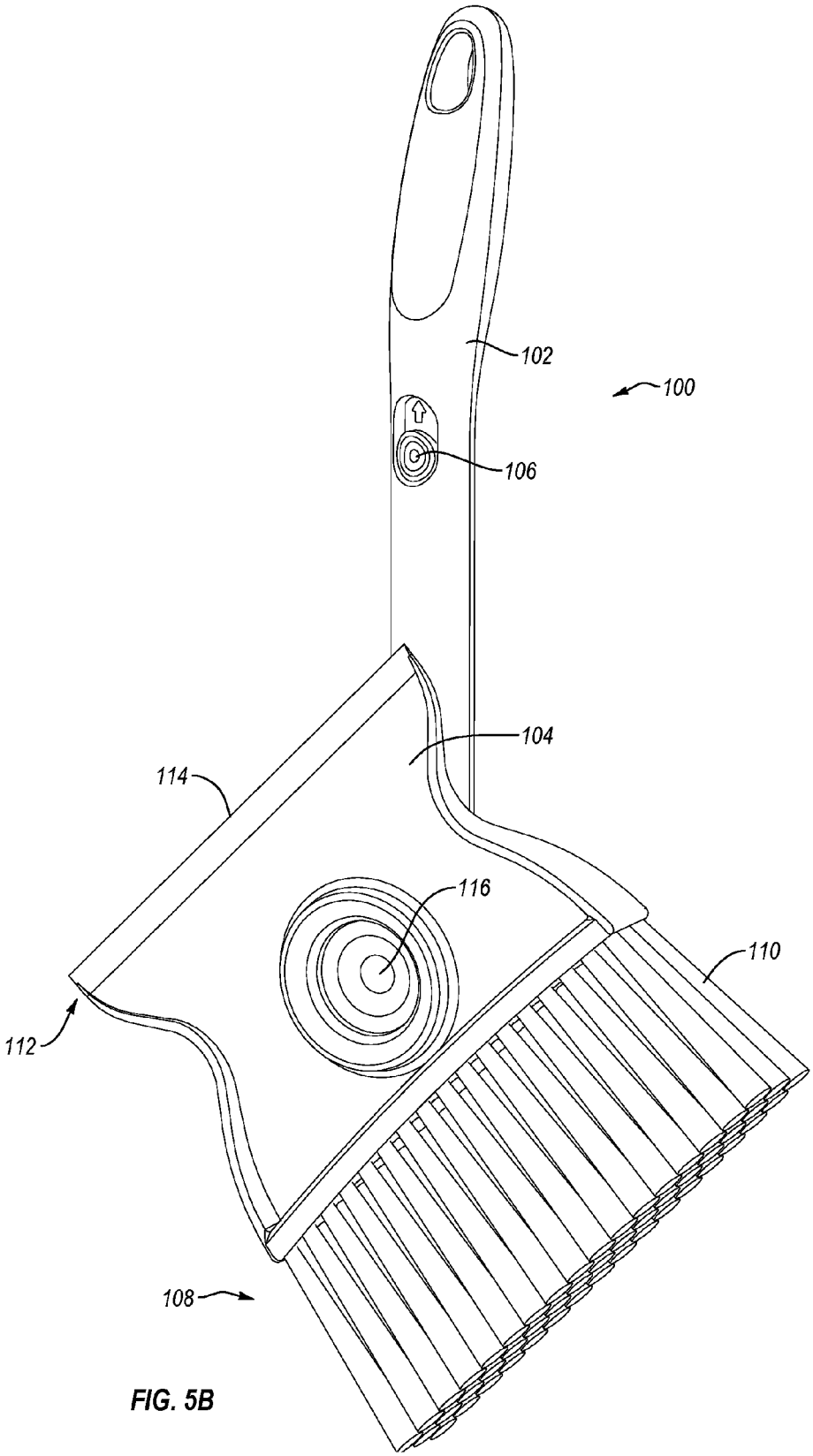
FIG. 5B shows rotation of the broom bristles to a selected angle of 45° relative to the "bristles down" configuration.
Figure 5C:
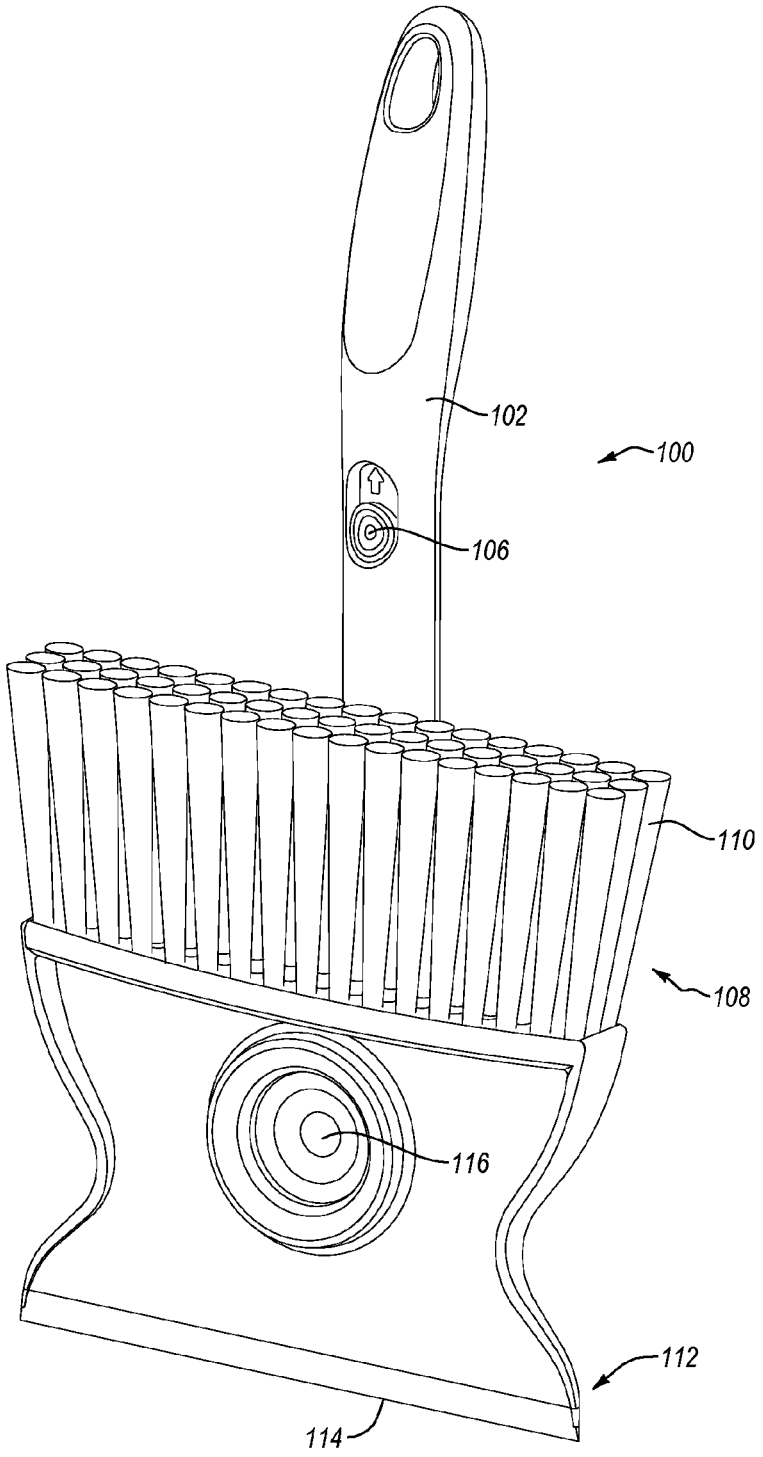
FIG. 5C shows rotation of the broom bristles to a selected angle of 180° relative to the "bristles down" configuration, so that the squeegee end of the head is oriented down.
Figure 6:
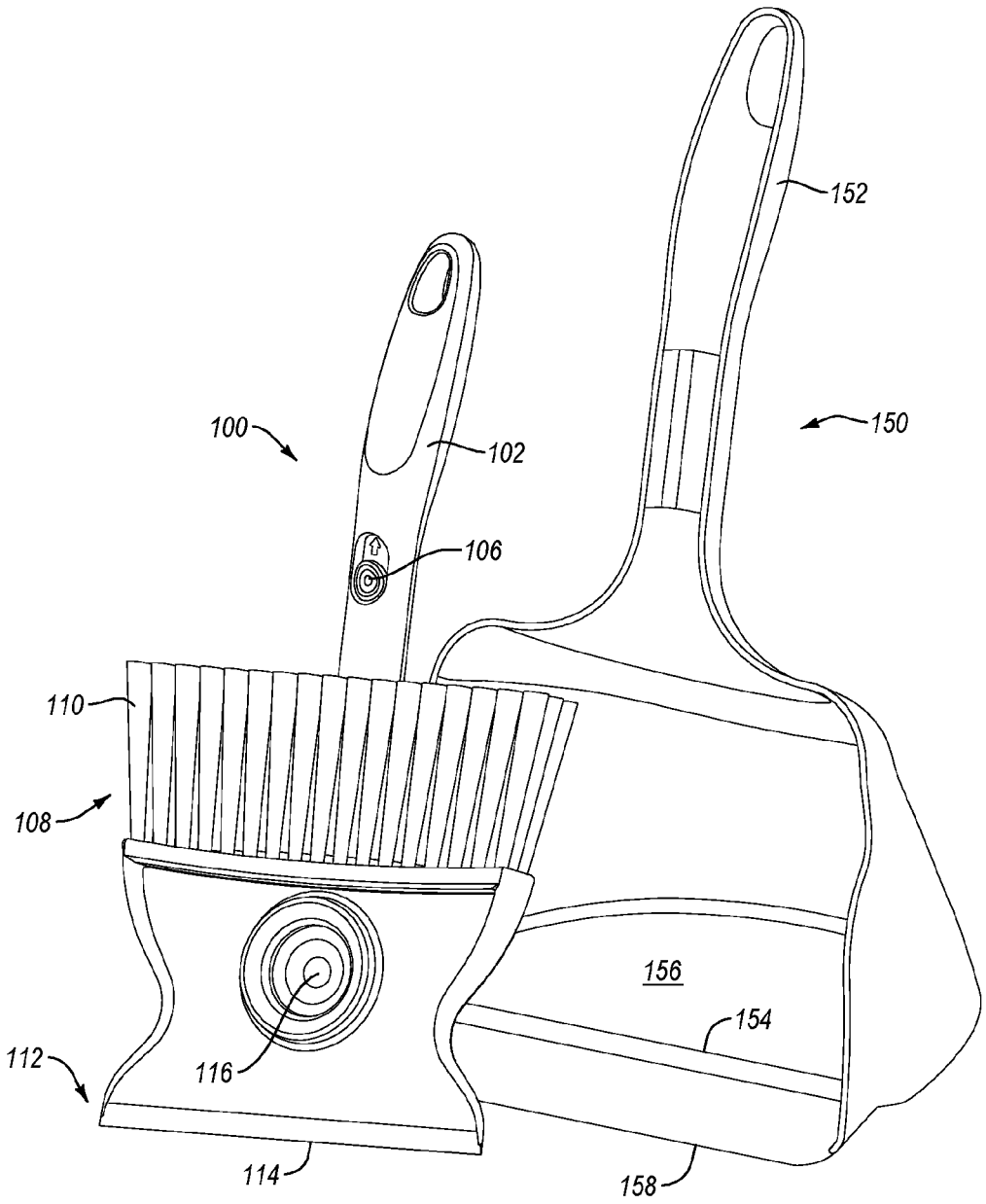
FIG. 6 shows the combination broom with the head rotated to the orientation of FIG. 5C to move liquid or wet waste or debris into the dustpan.

FIGS. 4-6 show release of head 104 and its rotation to various orientations other than the "bristles down" orientation of FIGS. 1-2. For example, in FIG. 4, button 106 is in a released position, allowing free rotation (e.g., 360°) of head 104 about handle 102, through coupling 116. Coupling 116 is shown disposed within a central portion of head 104, rather than disposed near either extreme end 112 or 108. Coupling 116 is also shown generally centered side-to-side within head 104. Although illustrated as such, other configurations may also be possible.

FIG. 5A shows head 104 having been rotated counterclockwise 90°, and then locked in that position (e.g., button 106 is shown in the down, or locked position). Such an orientation may be useful in sweeping a vertical surface (e.g., dusting, removing cobwebs or other debris from a wall, cabinet, or other vertical surface), or sweeping a relatively high horizontal surface (e.g., a countertop). Similar orientations, (and also those with the head rotated 180° from that shown) may also be useful where the squeegee edge is used on such a surface.

FIG. 5B shows head 104 having been rotated counterclockwise only 45°, and locked in that position relative to the position shown in FIG. 1. Such a configuration may be useful in sweeping cobwebs, dust, or other debris from crown molding that forms an angle between a vertical wall and a horizontal ceiling, or similarly oriented surfaces. While only these specific angled locked positions are shown, it will be appreciated that the coupling 116 may be configured to allow rotation of head 104 about handle 102 for a full 360°, and that locking may be provided at any desired positions along such full rotation (e.g., every 90°, every 45°, etc.). Other locking positions will be apparent to those of skill in the art.

FIG. 5C shows rotation of 180° from that shown in FIGS. 1-2, positioning squeegee blade 114 for use in cleaning a liquid spill or other debris from a floor or similar flat surface. FIG. 6 shows this locked orientation, adjacent to dustpan 150, e.g., so as to pull or otherwise move liquids or other wet debris into dustpan 150. Providing a rubber or elastomeric leading edge 108, as well as a retention dam 154 as described above may be particularly beneficial when using squeegee blade 114 to move liquids into dustpan 150. For example, dam 154 may aid in preventing such liquids from flowing out of dustpan 150, as they may otherwise tend to do merely under influence of gravity.

Figure 7:
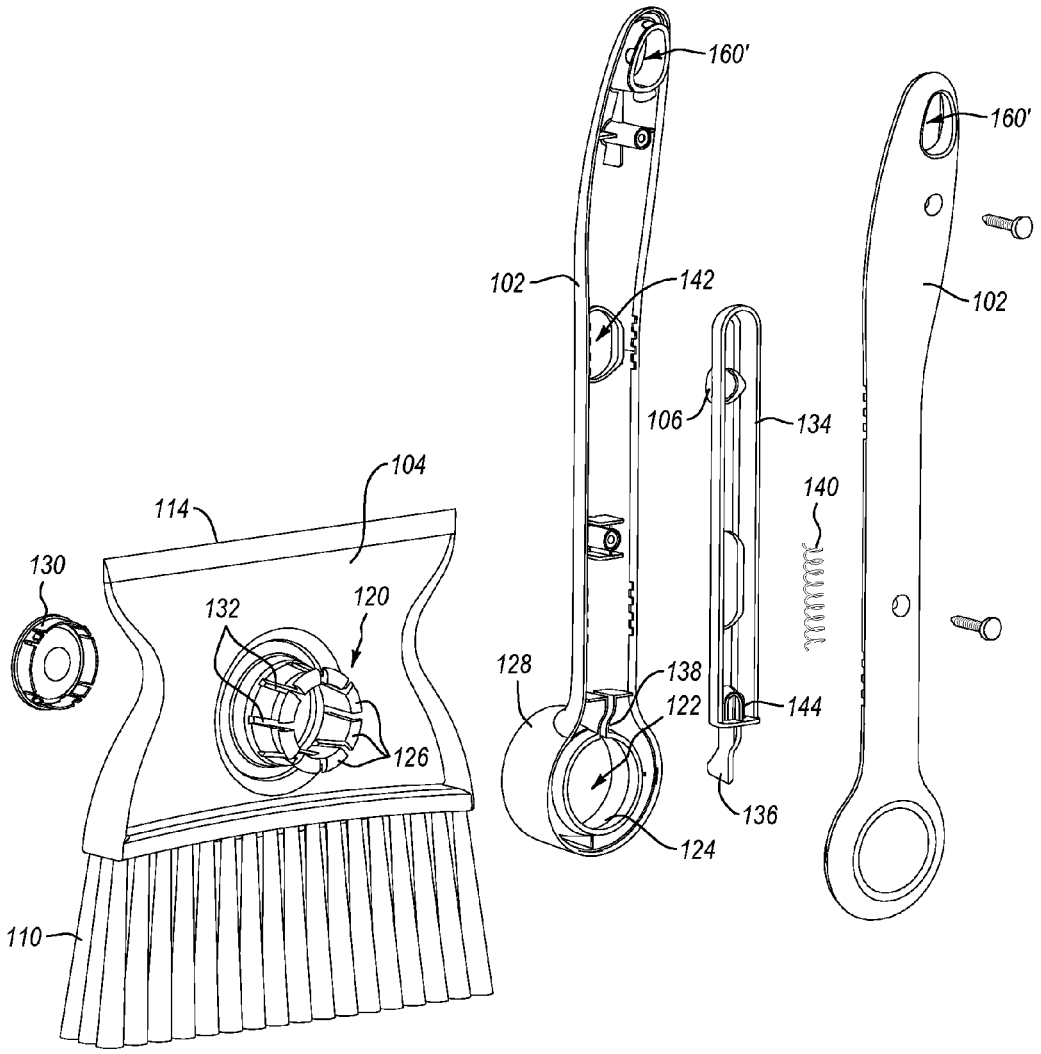
FIG. 7 shows an exploded view of the combination whisk broom and squeegee.
Figure 8A:
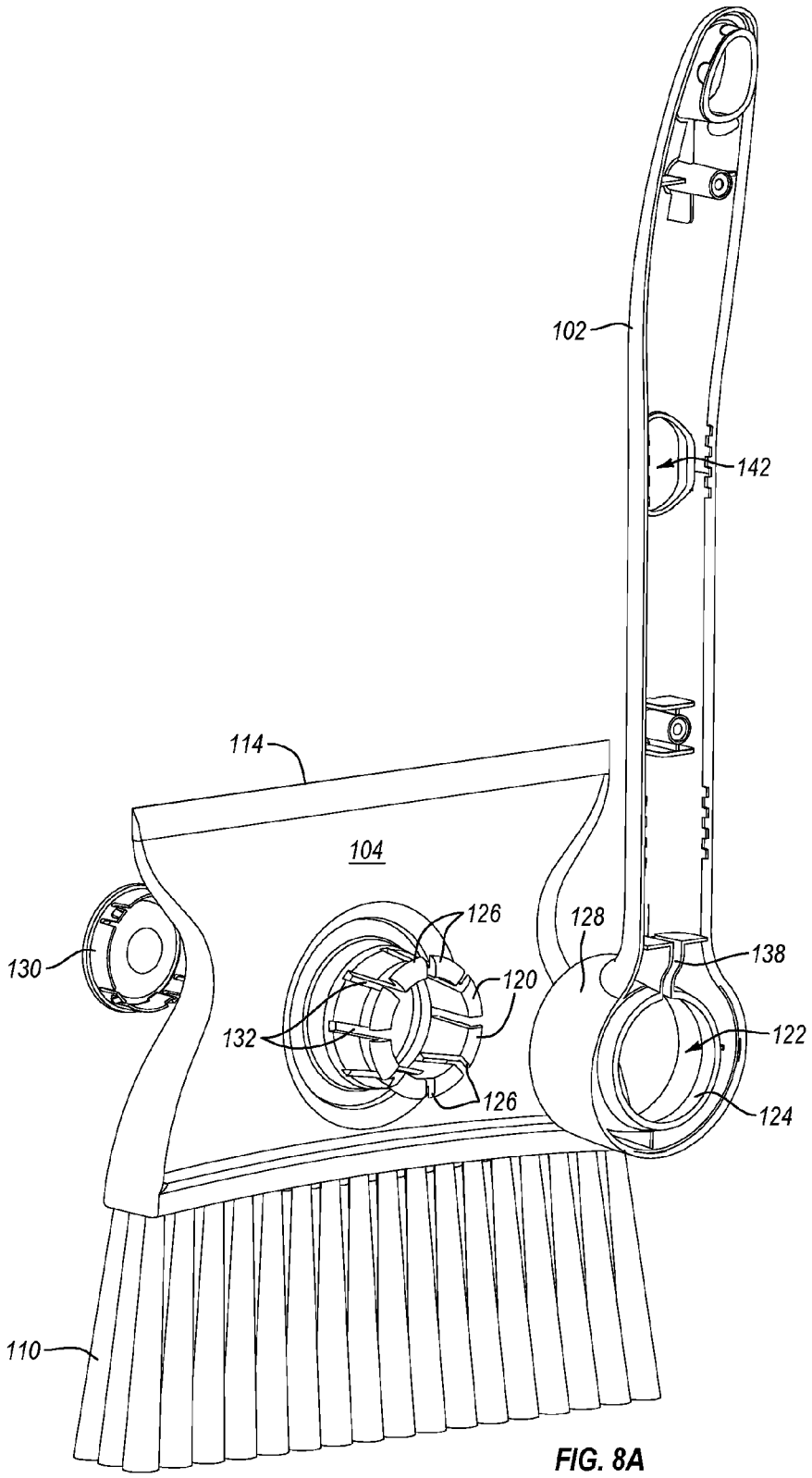
FIGS. 8A-8B show close up views of an exemplary snap-fit coupling that allows selective free rotation and selective locking of the combination broom and squeegee head into a desired orientation.
Figure 8B:
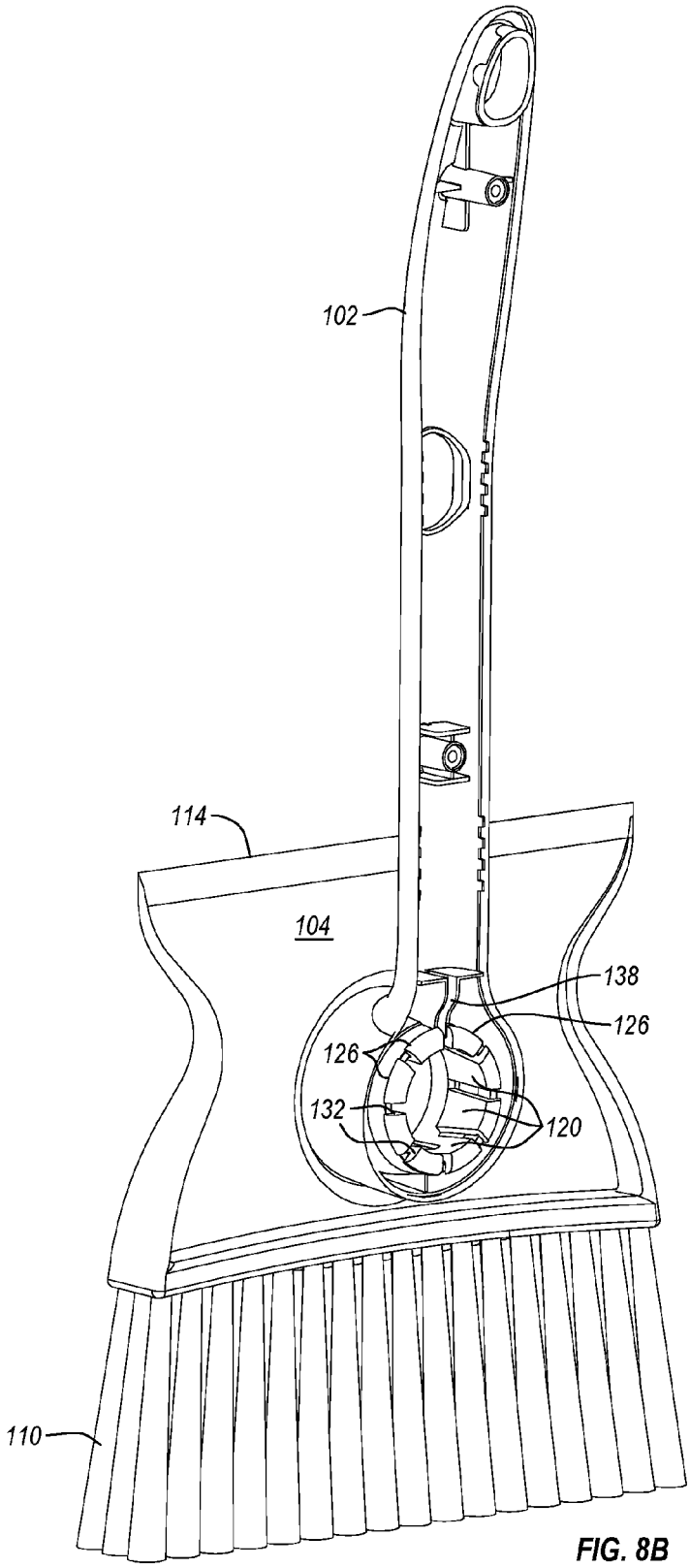
Figure 9:
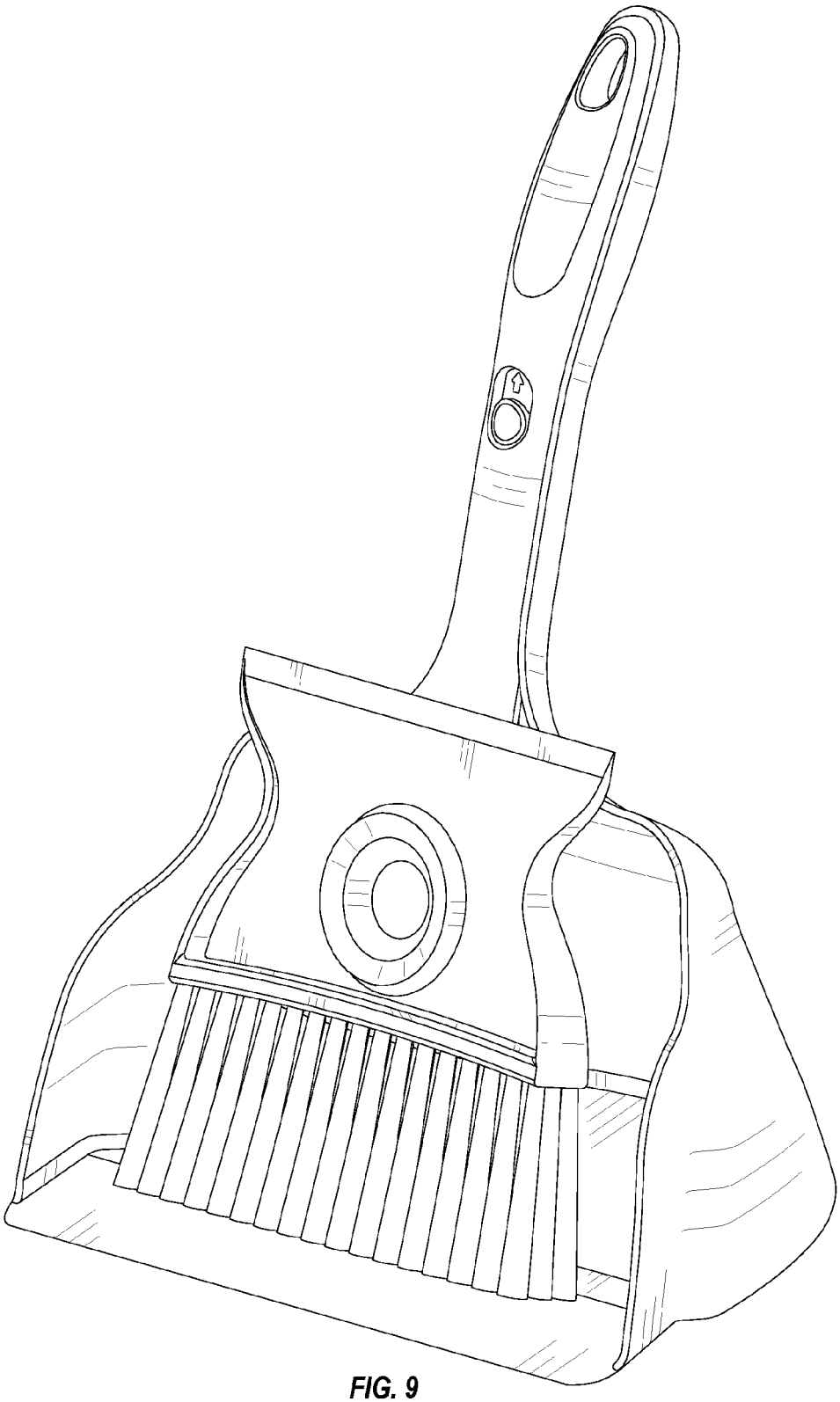
FIGS. 9-15 show a perspective view, a front view, a rear view, a side view, an opposing side view, a top view, and a bottom view, respectively, of an ornamental design of a combination whisk broom and squeegee according to the present invention.
Figure 10:
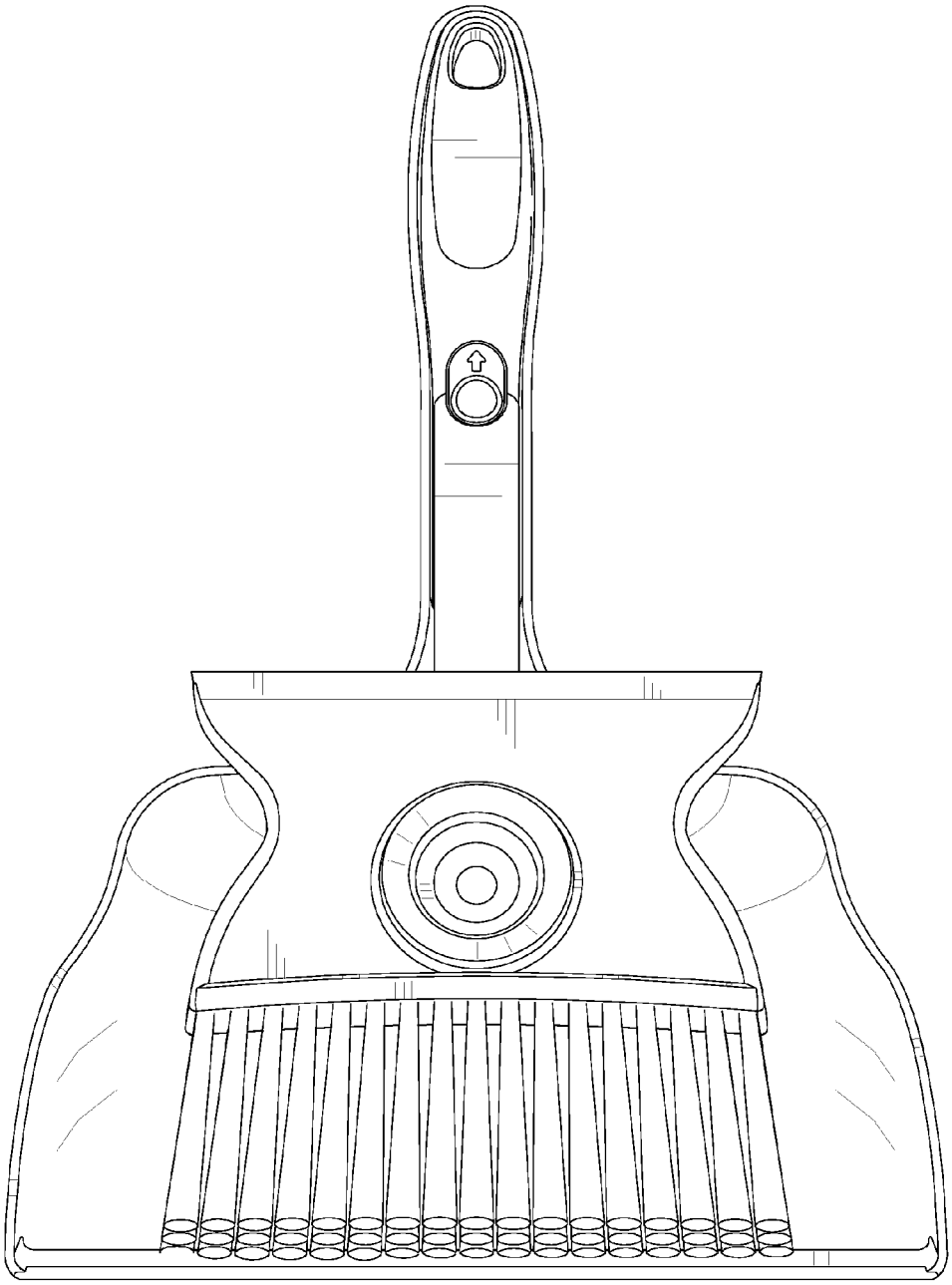
Figure 11:
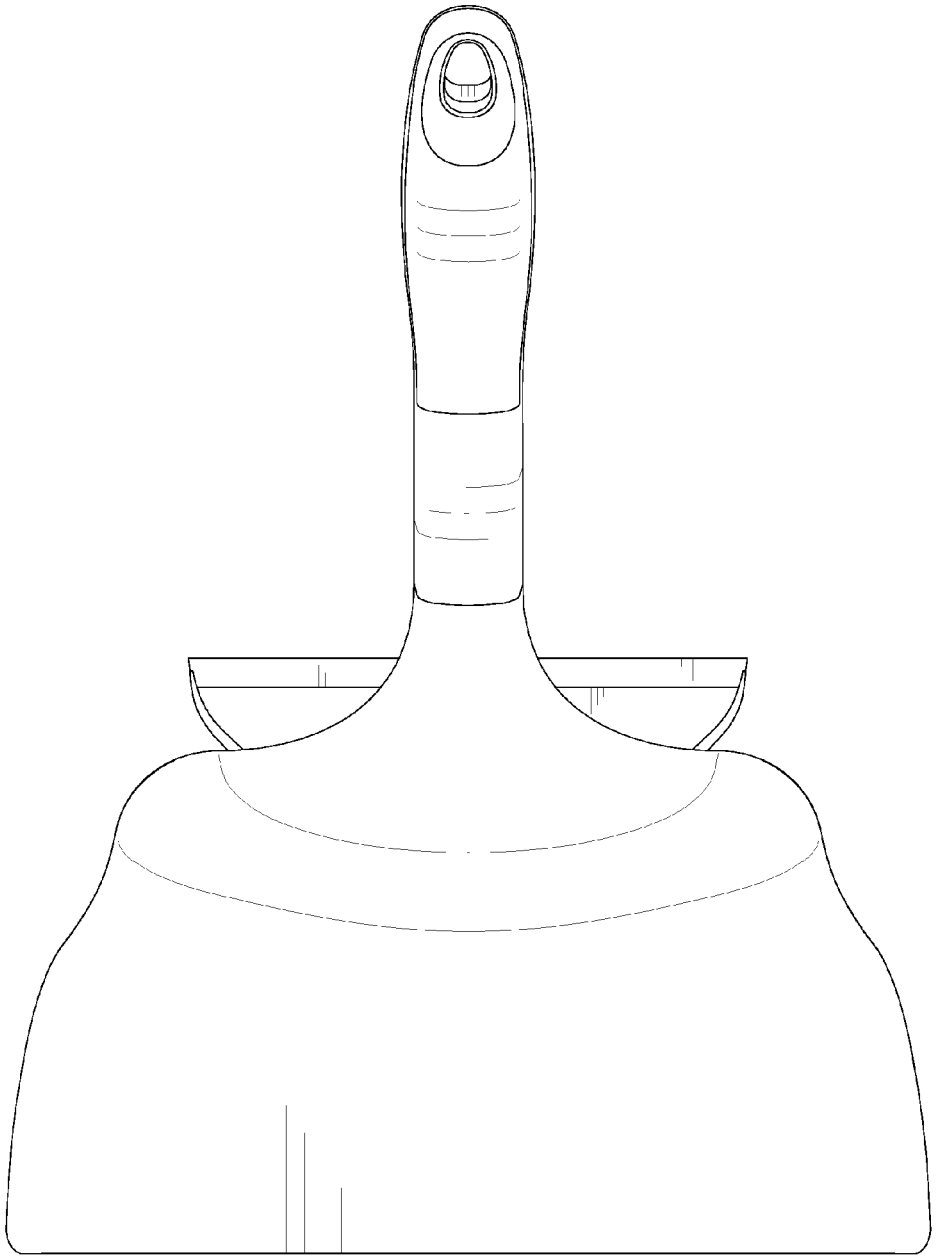
Figure 12:
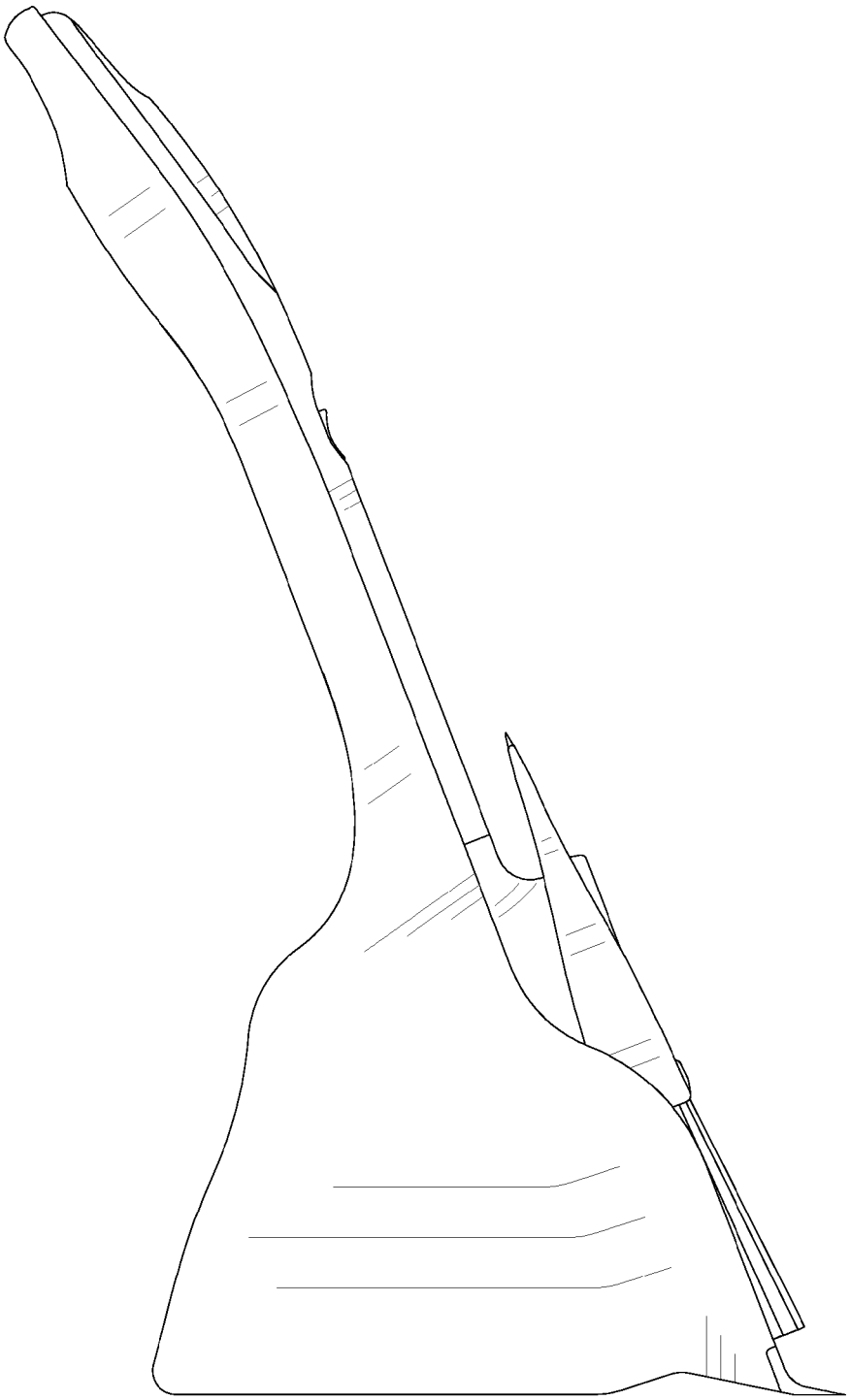
Figure 13:
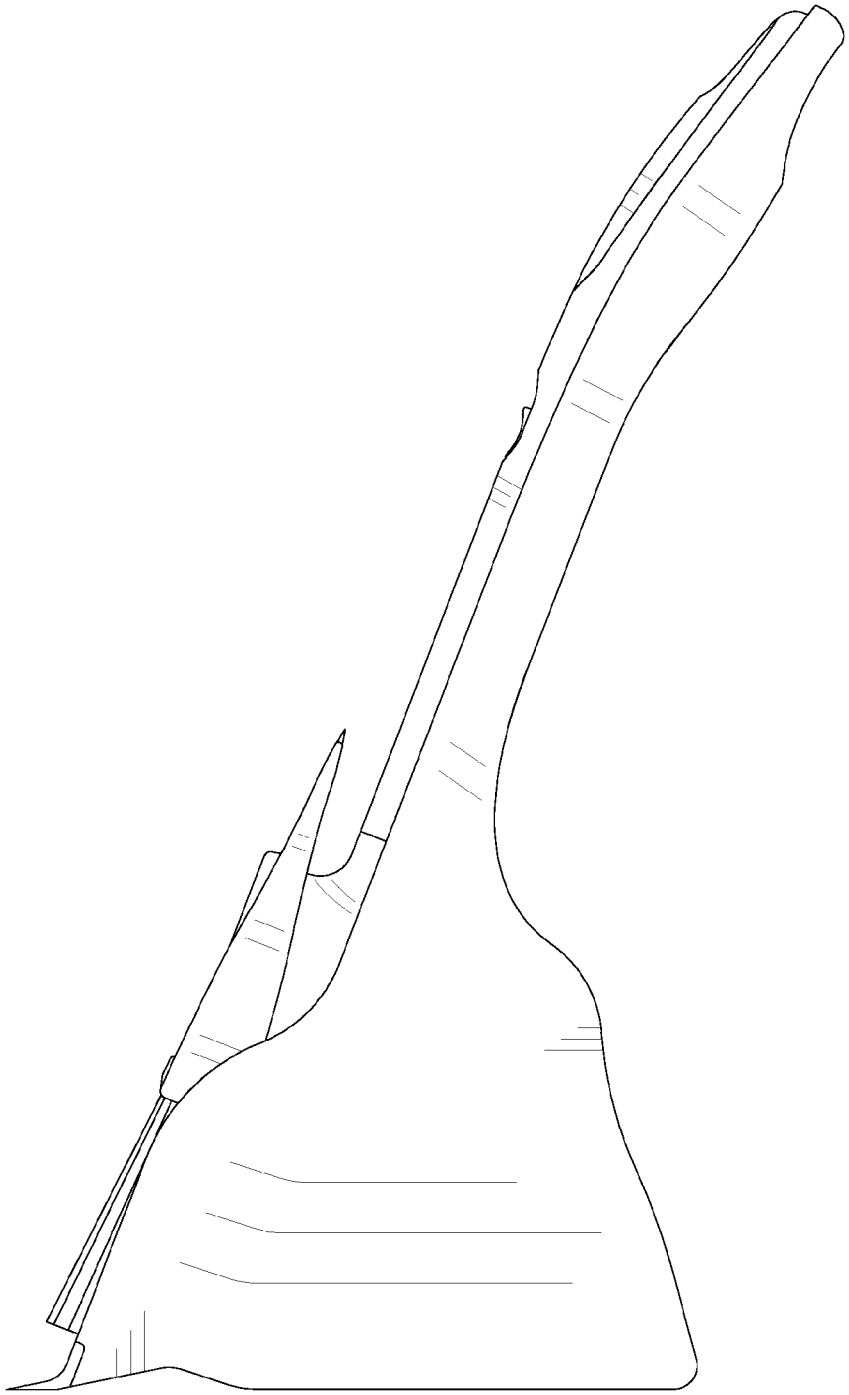
Figure 14:
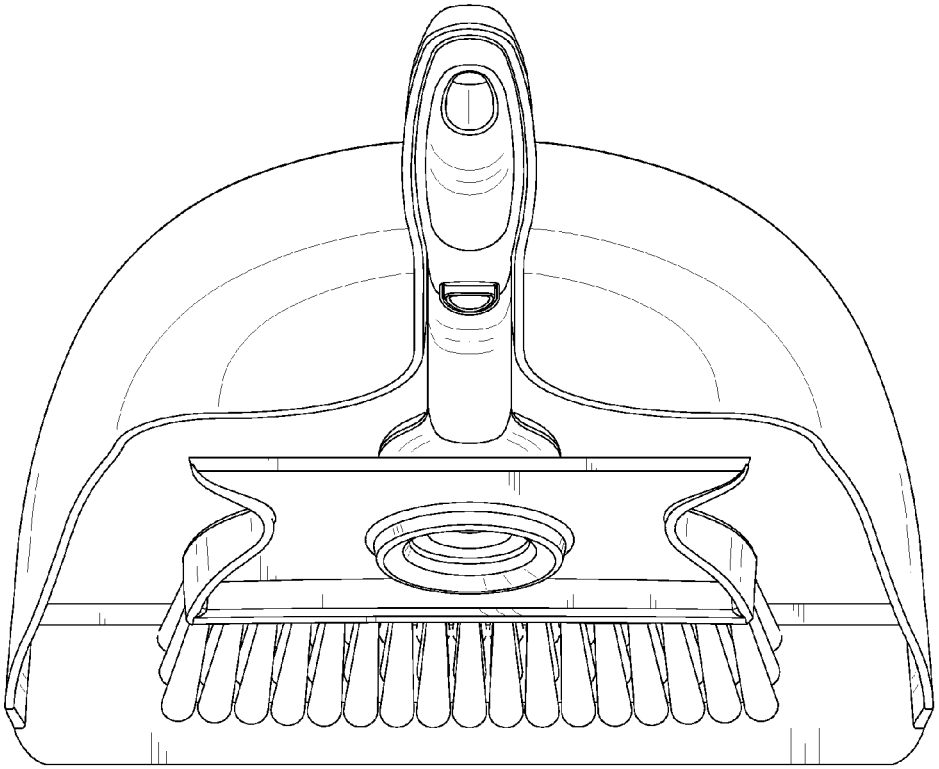
Figure 15:
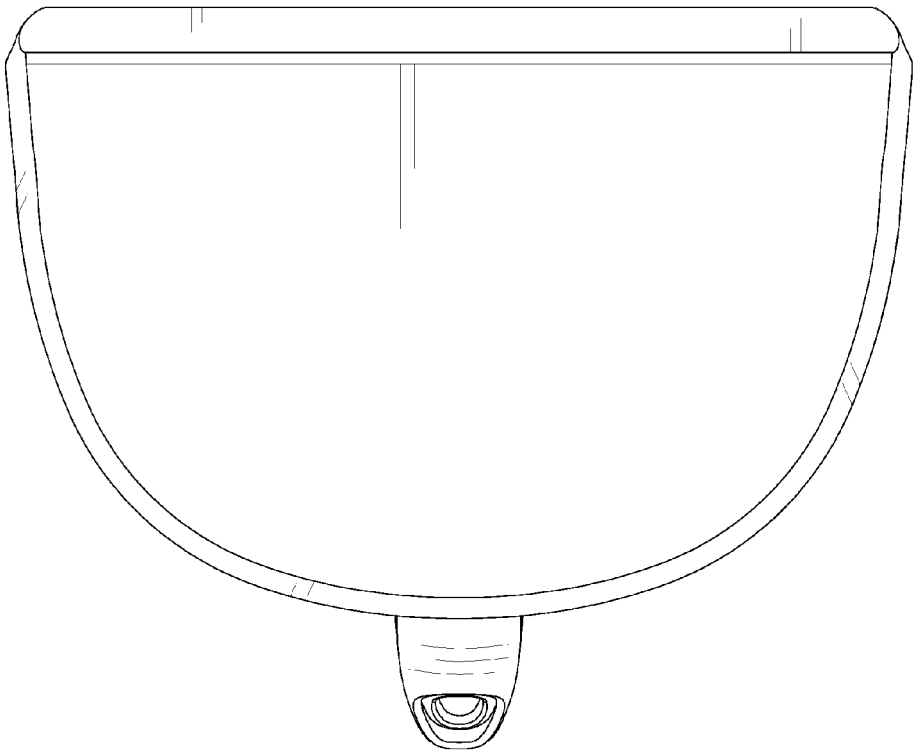
Figure 16:
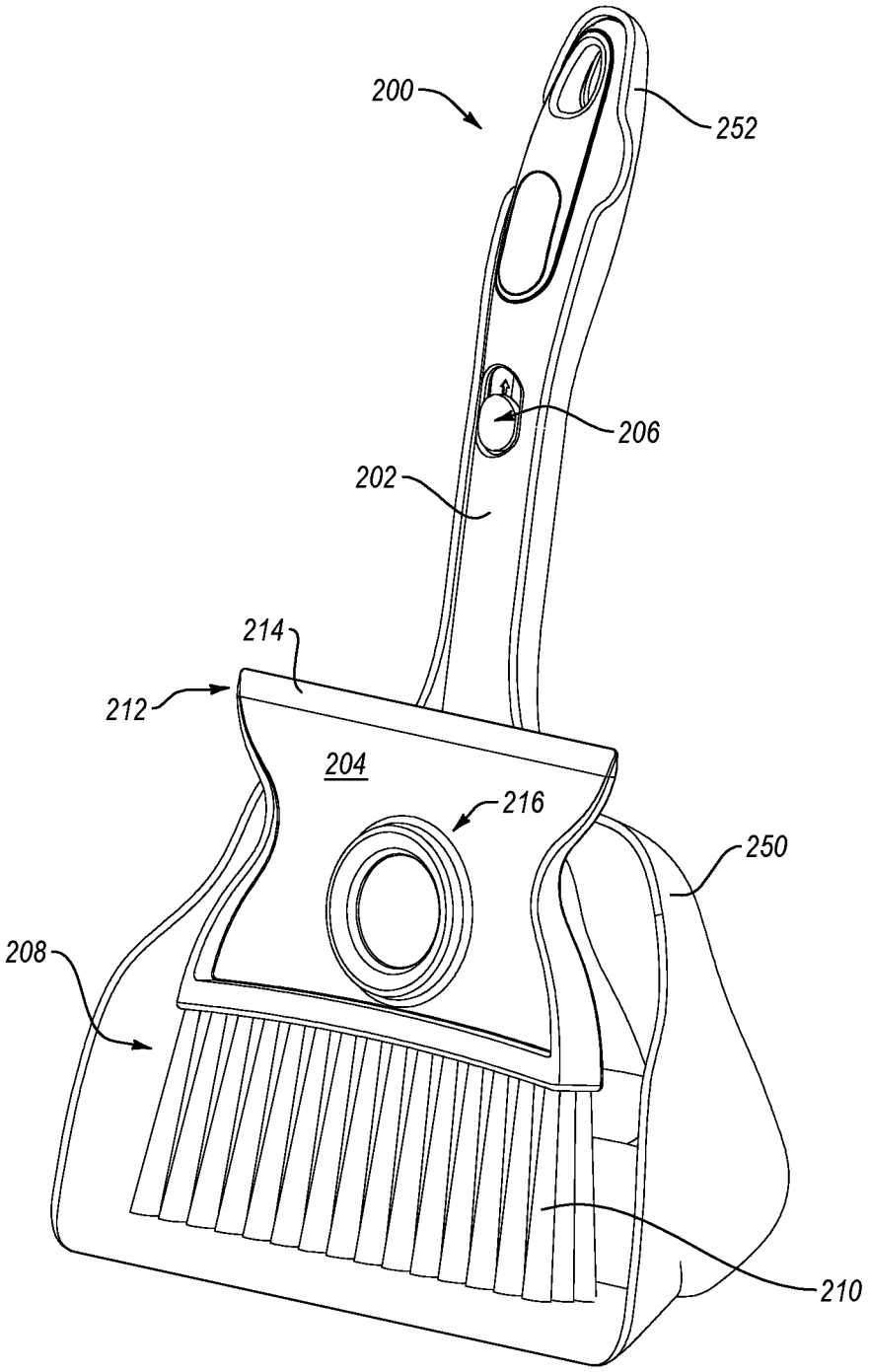
FIG. 16 is an isometric view of another exemplary combination whisk broom with squeegee, with a dustpan.

FIG. 7 shows an exploded view of device 100, illustrating coupling 116, as well as release button 106 and how they work together. FIGS. 8A and 8B show close up views of the coupling 116. For example, coupling 116 between head 104 and handle 102 may include a notched rearwardly extending cylinder 120 within head 104, which mates with a correspondingly shaped cylindrical recess 122 defined by cylindrical sidewall 124 of handle 102. Rearwardly extending cylinder 120 may have a length that is greater than the corresponding length of sidewall 124, so that when coupled with one another, as shown in FIG. 8B, the distal ends of notched cylinder 120 extend past the corresponding distal ends of sidewall 124. The extreme distal end of cylinder 120 may include an outwardly flared flange 126, as shown, allowing cylinder 120 to "snap" into place within cylindrical recess 122 upon coupling, as shown in FIG. 8B.

Because cylinder 120 is notched, it can easily flex inwardly (i.e., compress) as it is introduced into cylindrical recess 122. As soon as it is fully inserted, the outwardly flared flange ends 126 snap outwardly, so as to overhang the distal end of sidewall 124, coupling cylinder 120 and handle 102 together in a snap-lock connection. The coupling provides for free rotation of cylinder 120 within recess 122, and thus head 104 about handle 102.

As shown, handle 102 may terminate at its bottom end in an enlarged cylinder shape 128, which cylinder 128 may extend generally forwardly (opposed to the rearward extension of cylinder 120). Cylinder 128 is hollow, and includes sidewall 124 defining inner cylindrical recess 122 which mates with notched cylinder 120. As seen in FIG. 7, a covering cap 130 may be provided for fitting over (e.g., snap fitting) an open front end of the coupling structure of head 104. As is apparent in FIGS. 7-8B, the notches 132 of cylinder 120 may be spaced evenly (e.g., about every 45°, or about every 90°, etc.) about the circumference of cylinder 120. Notches 132 are shown extending fully to the distal end of cylinder 120, defining a plurality of tabs, so as to facilitate easy compression thereof as cylinder 120 is inserted into recess 122.

Referring again to FIG. 7, release button 106 may be coupled to coupling 116 by a sliding elongate locking pin 134 which extends longitudinally, down into handle 102. The distal end of sliding locking pin 134 includes a distal pin end 136, which is able to pass through channel 138 defined through sidewall 124, allowing distal pin end 136 to selectively engage with a given notch of notched cylinder 120 of head 104. Engagement of pin end 136 within any given notch 132 locks cylinder 120 against rotation. Upward sliding of locking pin 134 (and thus pin end 136) out of notch 132 (but still within guiding channel 138) frees head 104 so as to allow its rotation about handle 102. Sliding is achieved through use of release button 106, accessible on the front surface of handle 102. While locking pin 134 is not shown in FIGS. 8A-8B to more clearly show coupling 116, it will be understood that distal pin end 136 rides within channel 138, and into a single designated notch 132, as will be apparent from FIG. 7.

The handle 102 may include front and rear portions fastened together (e.g., snap fit and/or with fasteners such as screws, adhesive, etc.). Sliding locking pin 134 may be spring loaded (e.g., spring 140) within handle 102 so that button 106 is biased to a position corresponding to one where head 104 is locked against rotation relative to handle 102. Locking pin 134 may further include a spring retention protrusion 144 at its bottom end, adjacent the distal pin end 136, for retaining spring 140. Release button 106 may comprise a portion of sliding locking pin 134, which is manually accessible through a window 142 cut-out in the front portion of handle 102. The release button 106 and elongate sliding locking pin may be an injection molded single piece. Many of the other structures (e.g., forward and rear handle 102 halves, the head 104, the dustpan 150, etc.) may similarly be injection molded. As perhaps best seen in FIG. 1, the top portion of handle 102 may include an overmolded rubber or other elastomeric material 146 to increase tactile feel and grip for the user.

As will be apparent from the Figures, bristles 110 and squeegee 114 may be within the same plane, at opposite ends of rotatable head 104. A significant distance may separate bristles 110 from squeegee 114, which minimizes risk that bristles 110 would become contaminated or otherwise dirtied when using squeegee 114 to clean up liquid spills. Furthermore, such separation allows one to easily and efficiently rinse, wash or clean squeegee 114 without risk of wetting bristles 110. Anyone who has attempted to sweep with a wet broom (or sweeping through puddles on the floor) will appreciate such an advantage. In an embodiment, separation between the bristles and the squeegee is at least 50 mm, at least 80 mm, or at least 100 mm, from about 50 mm to about 200 mm, from about 80 mm to about 150 mm, or from 100 mm to about 125 mm (e.g., about 115 mm).

The combination device is taller than many existing broom and dustpan devices, and is configured to permit its use in a semi-upright posture of the user, rather than requiring the user to crouch down on their knees during use, as is often required. Such benefit is provided at least in part by the upright configuration of the dustpan, in which the handle extends more vertically than horizontally, and in which the combination device has a length (height) of about 14 to 20 inches (e.g., 14-15 inches). Such a height and the generally upright configuration permits an average user (e.g., from 5 to 6 feet in height) to use the combination device and dustpan as intended, in a semi-upright posture, with little or no bending of the knees.

FIGS. 16-21 illustrate another combination whisk broom and squeegee device 200 in combination with a dustpan 250. Combination device 200 includes an elongate handle 202, and a rotatable head 204 that is rotatably attached to handle 202. As with head 104, head 204 includes a whisk broom end with a plurality of bristles 210 at one end 208 thereof, and a squeegee 214 at an opposite end 212 of head 204. Head 204 is similarly selectively rotatable and lockable in a desired orientation relative to handle 202, to orient whisk broom end 208 (and bristles 210) or squeegee end 212 (and squeegee 214) in a desired orientation relative to the handle (see FIGS. 2-6). A release button 206 is similarly provided, on or within handle 202 that cooperates with the mechanism coupling head 204 to handle 202, so as to allow for selective release and selective locking of head 204 in a desired orientation.

Figure 17:
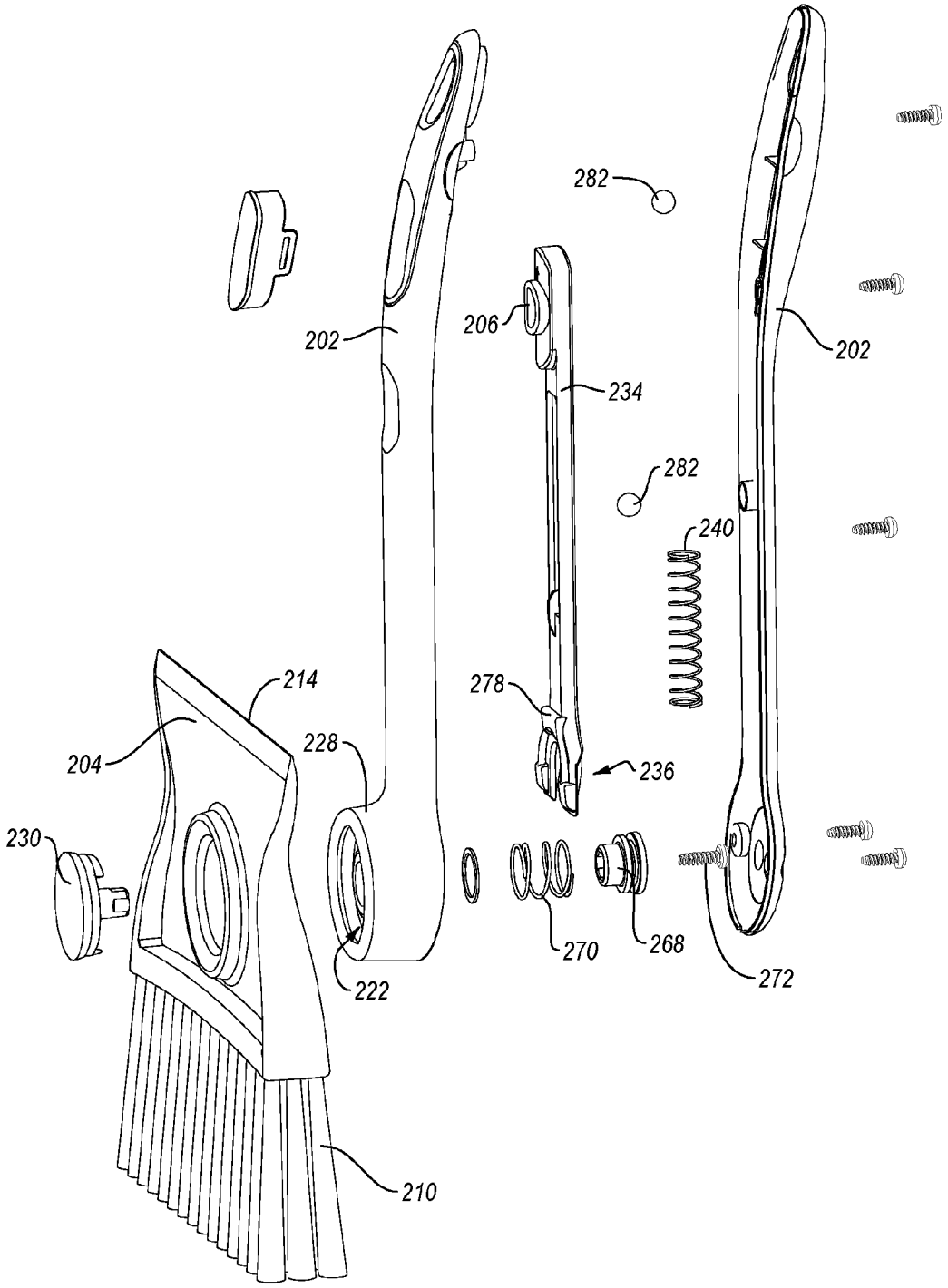
FIGS. 17-18 show exploded views of the combination whisk broom and squeegee of FIG. 16.
Figure 18:
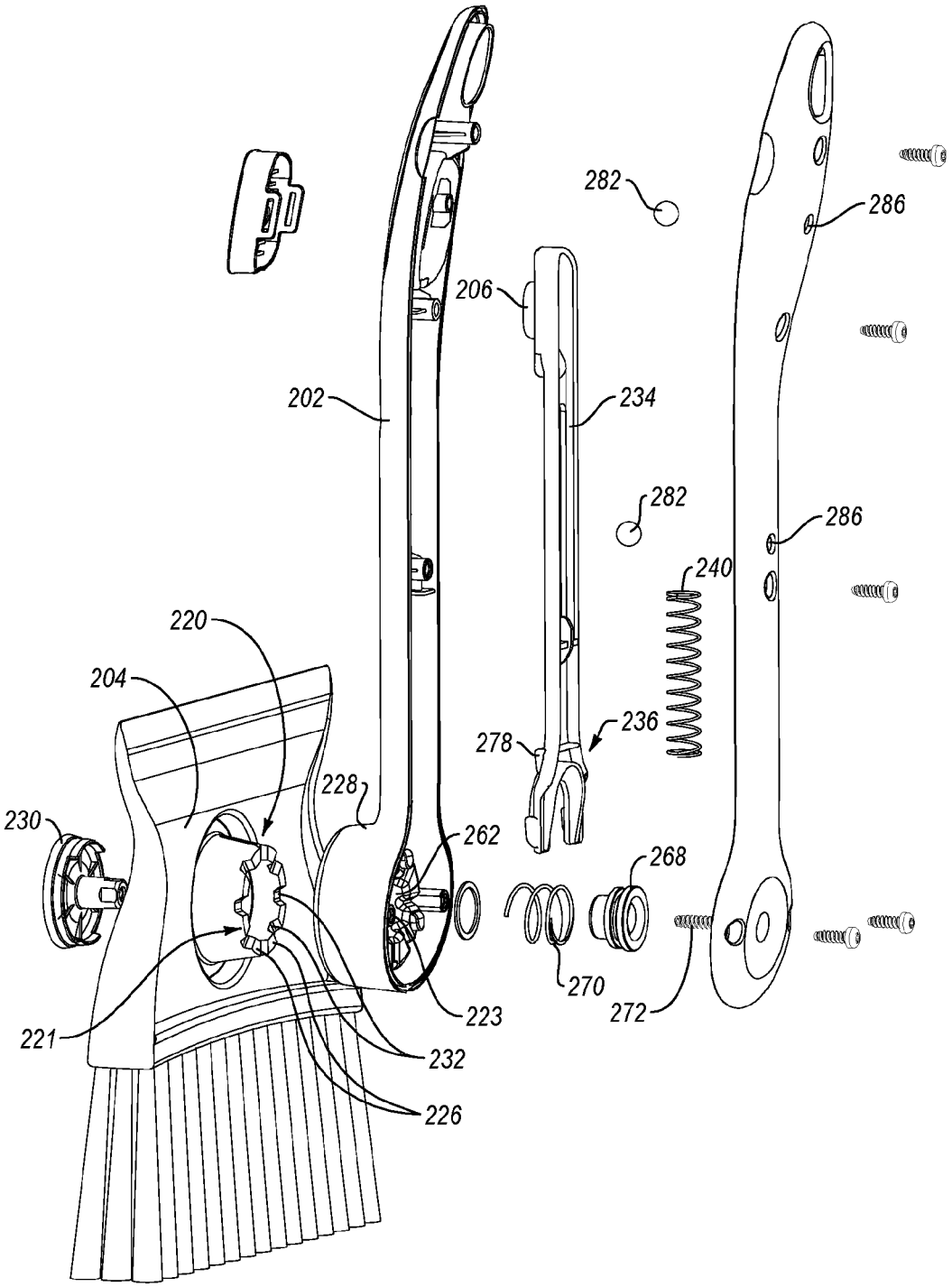
Figure 19:
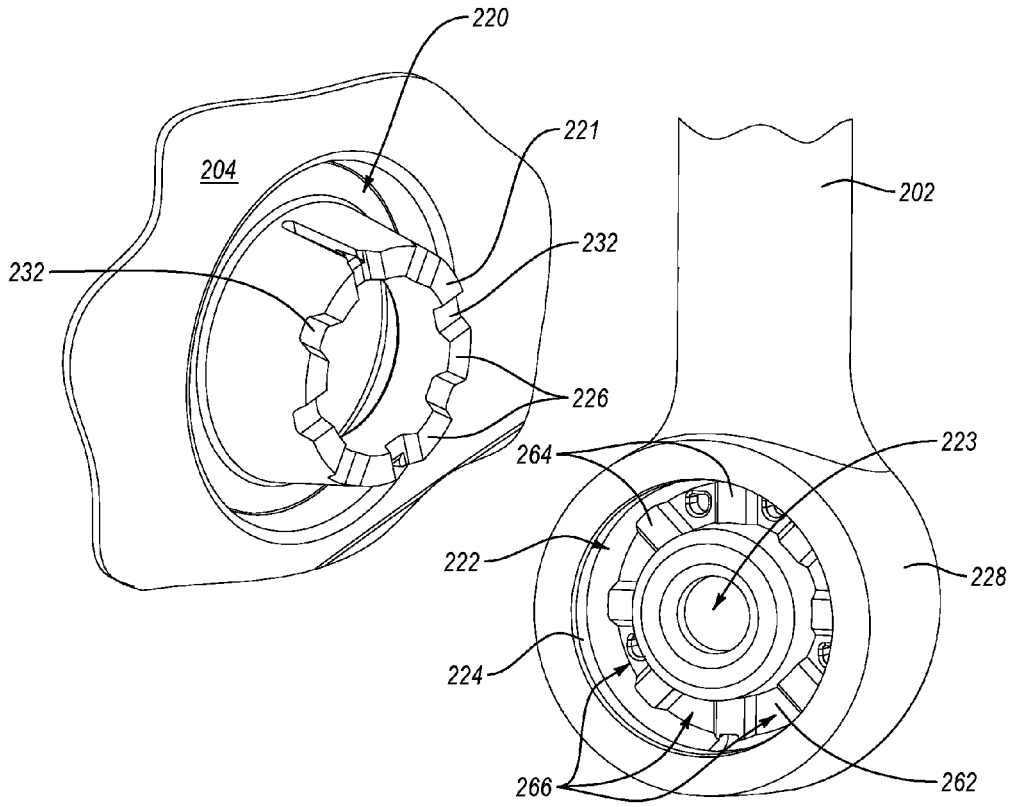
FIG. 19 shows a close up view of the rear surface of the rotatable head and the forward surface of the bottom of the handle of the combination whisk broom with squeegee device of FIG. 16, which couple to one another.
Figure 20A:
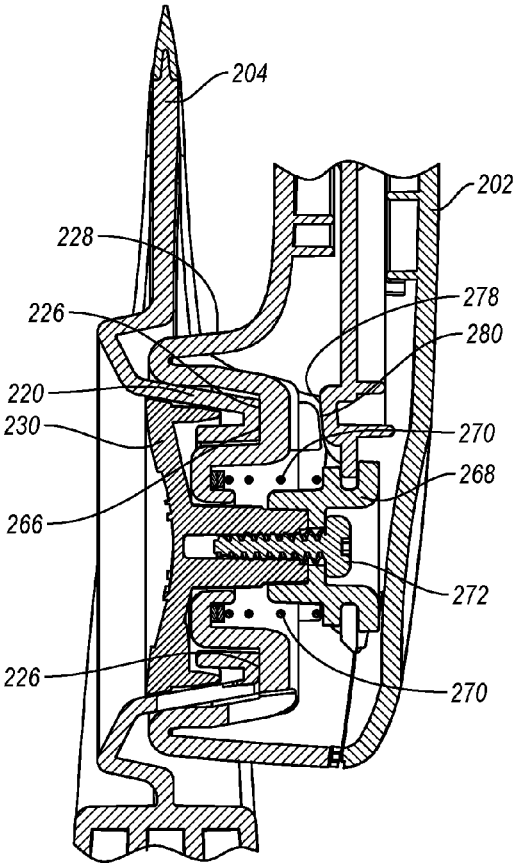
FIG. 20A shows a cross-section through the coupling mechanism of the rotatable head and the bottom of the handle with the rotatable head locked relative to the handle.
Figure 20B:
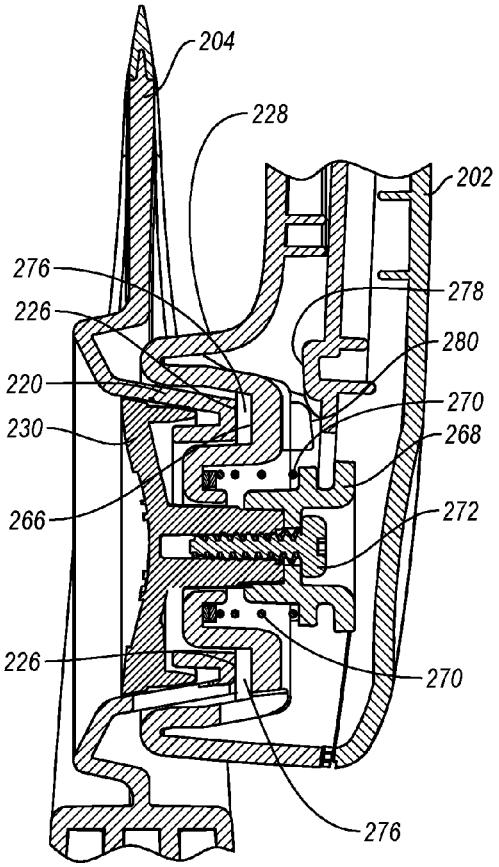
FIG. 20B shows a cross-section through the coupling mechanism of the rotatable head and the bottom of the handle with the rotatable head unlocked relative to the handle.
Figure 20C:
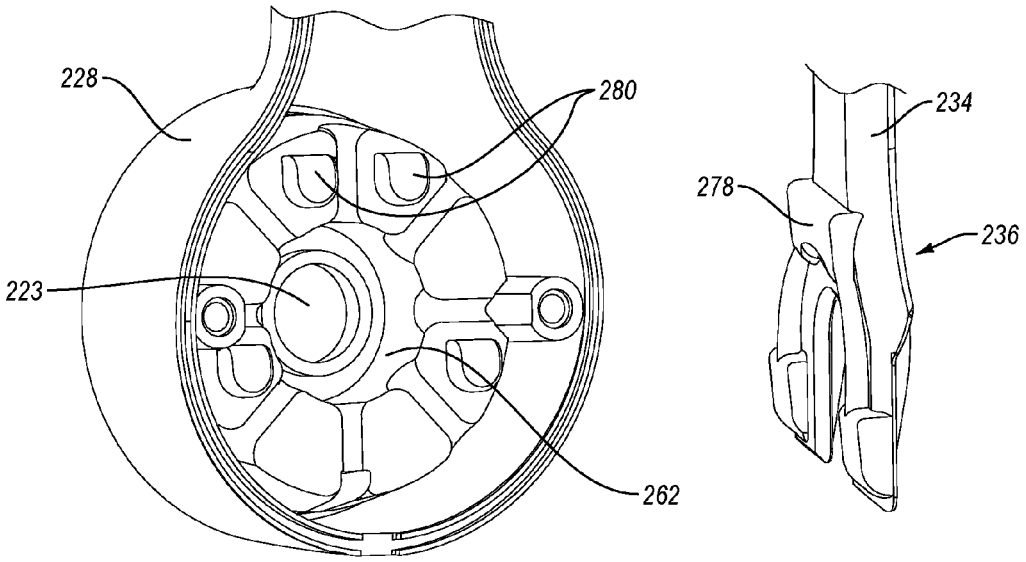
FIG. 20C shows close up views of the front side of the locking pin and the rear side of the handle.
Figure 21:
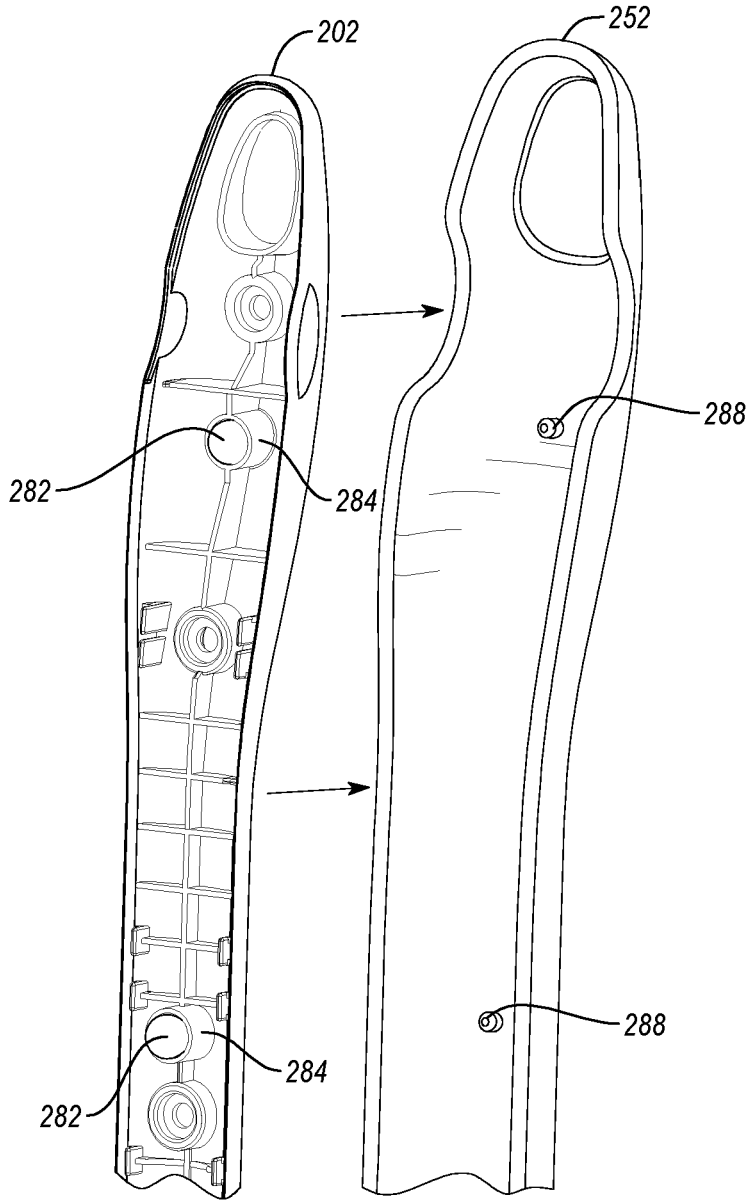
FIG. 21 shows an exploded view illustrating how the handle of the combination device may be magnetically retained within the handle of the dustpan.
Figure 22:
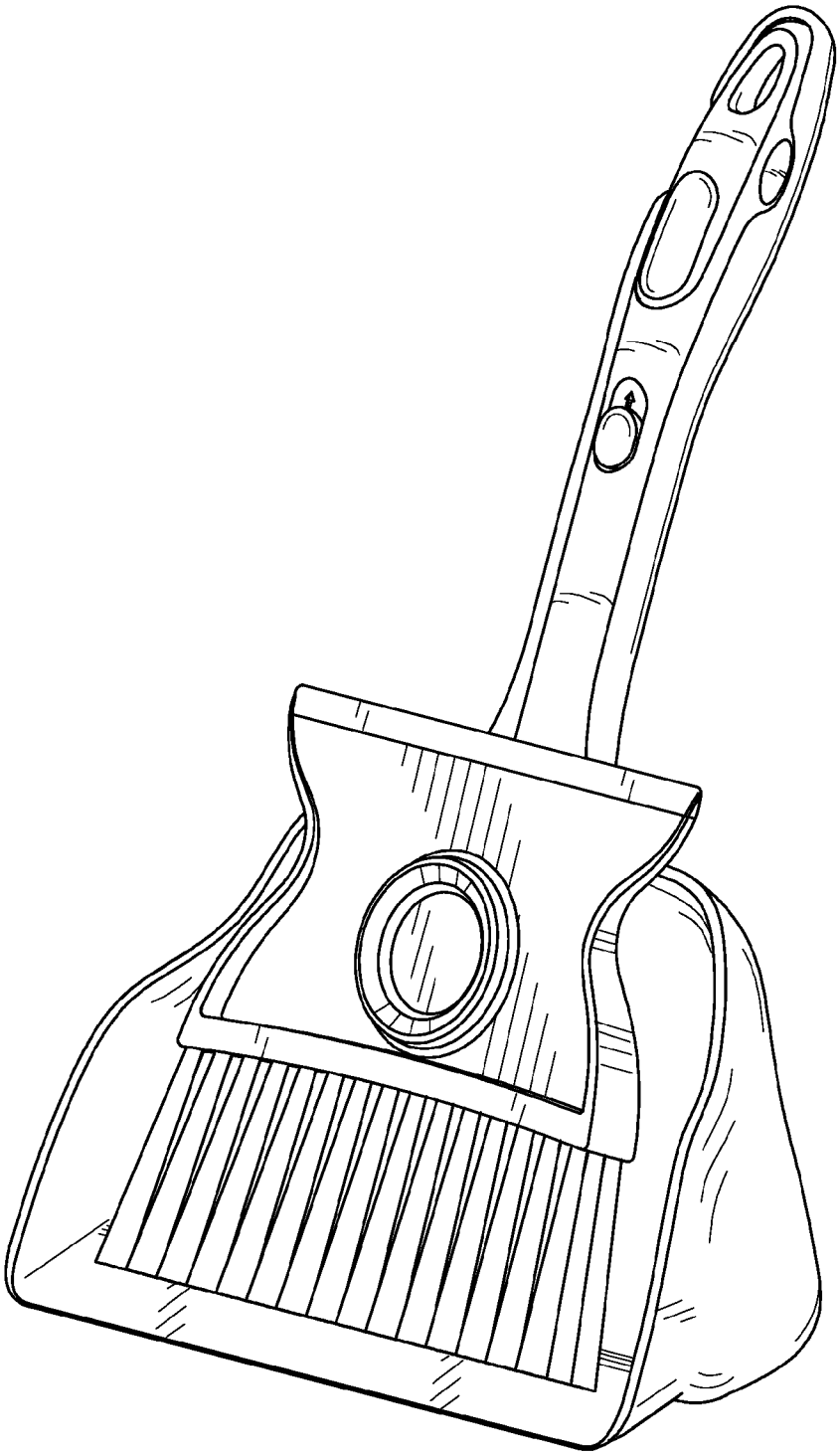
FIGS. 22-28 show a perspective view, a front view, a rear view, a side view, an opposing side view, a top view, and a bottom view, respectively, of an ornamental design of a combination whisk broom and squeegee according to the present invention.
Figure 23:
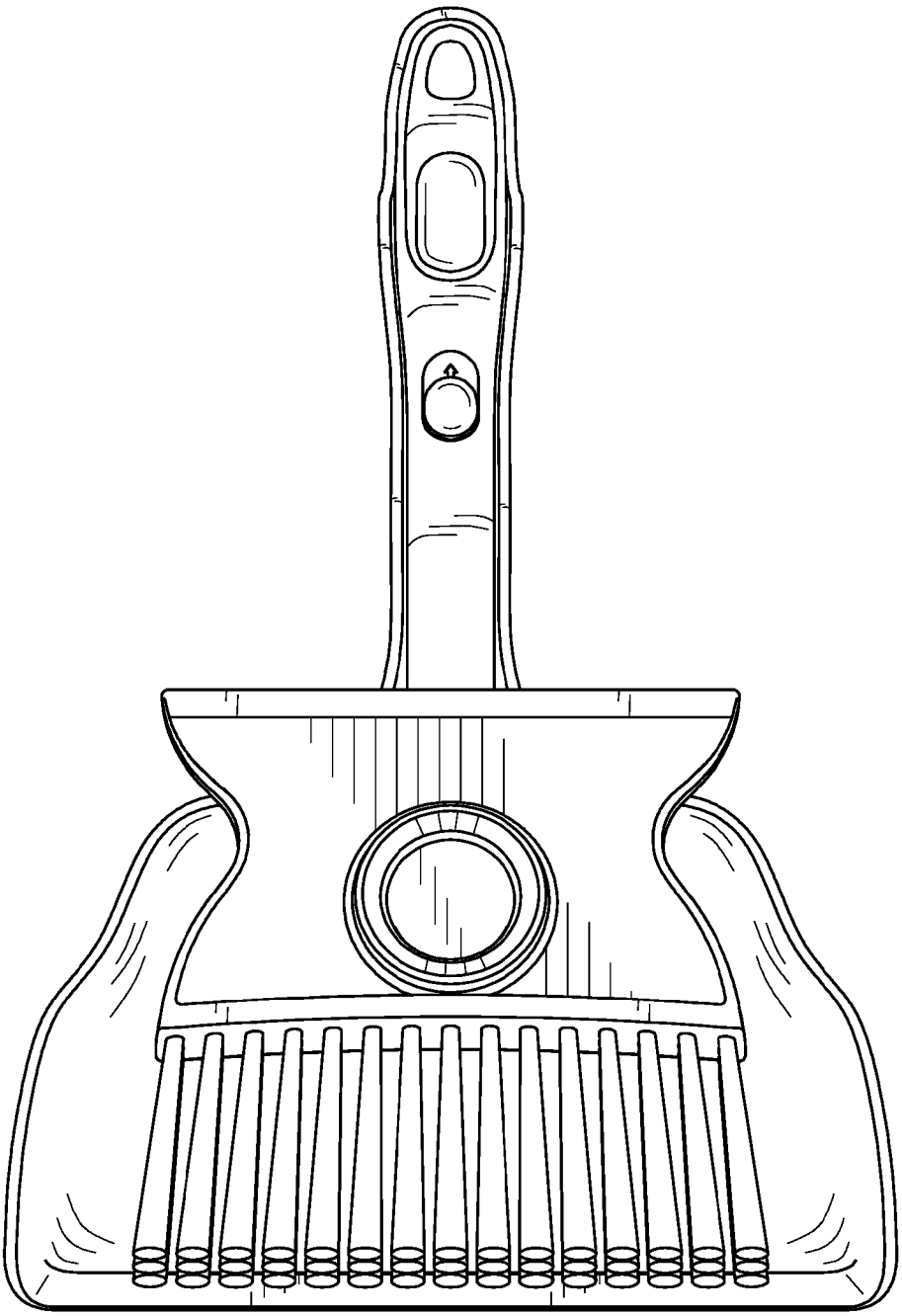
Figure 24:
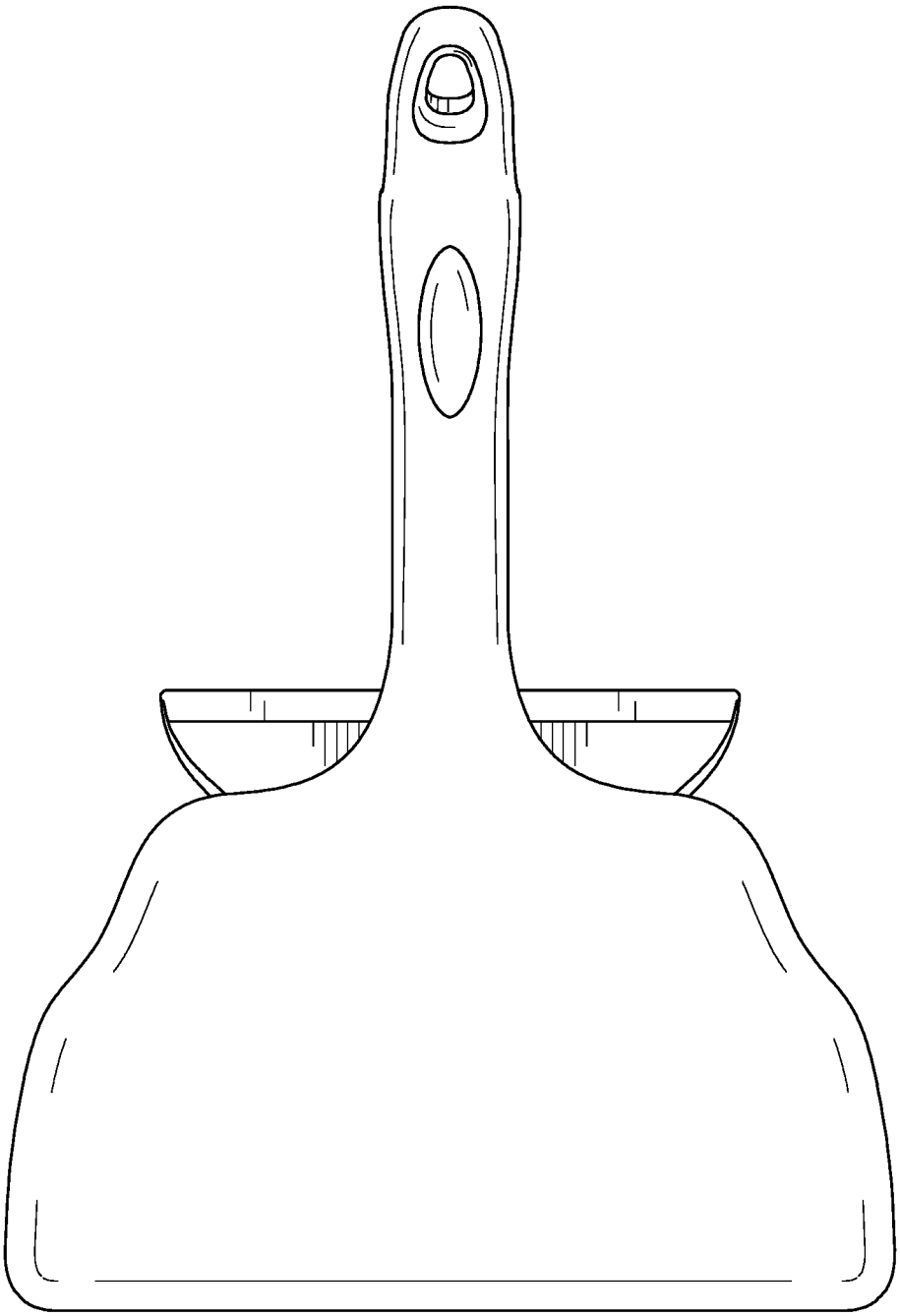
Figure 25:
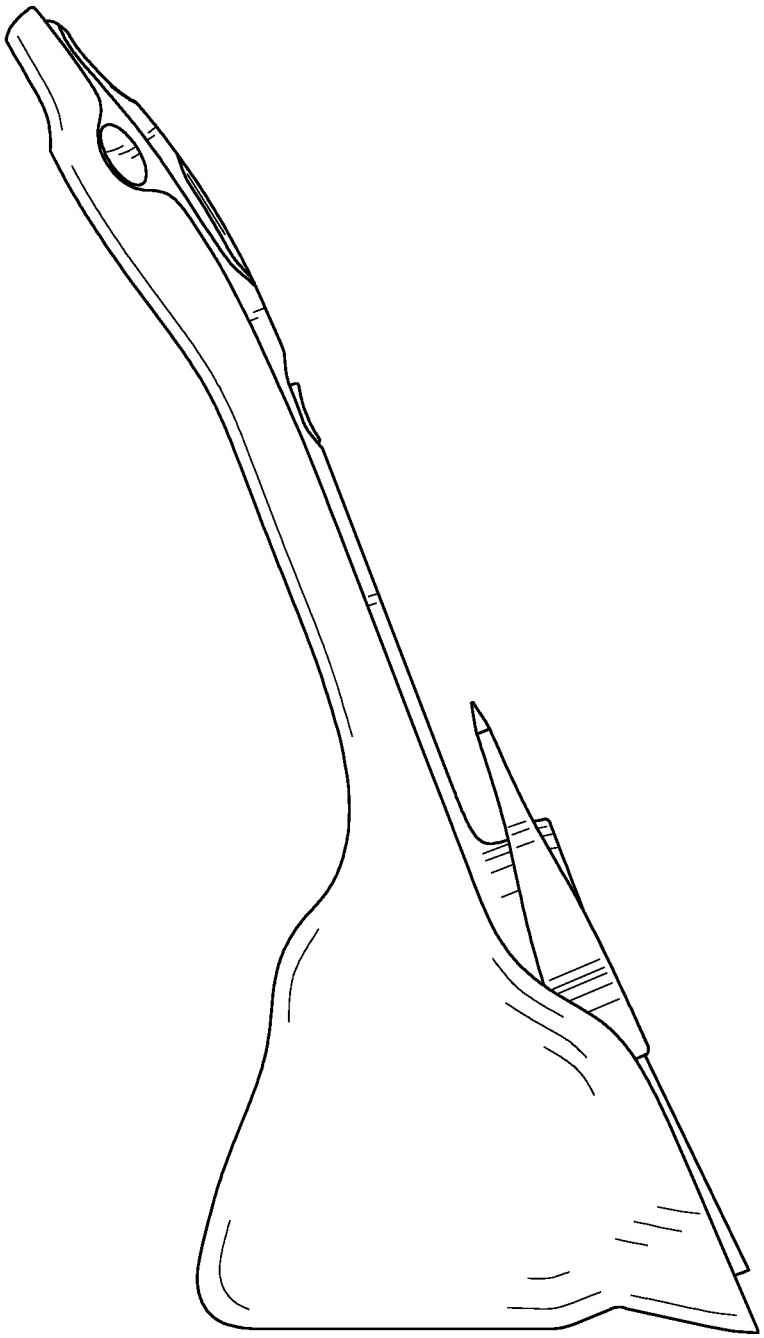
Figure 26:
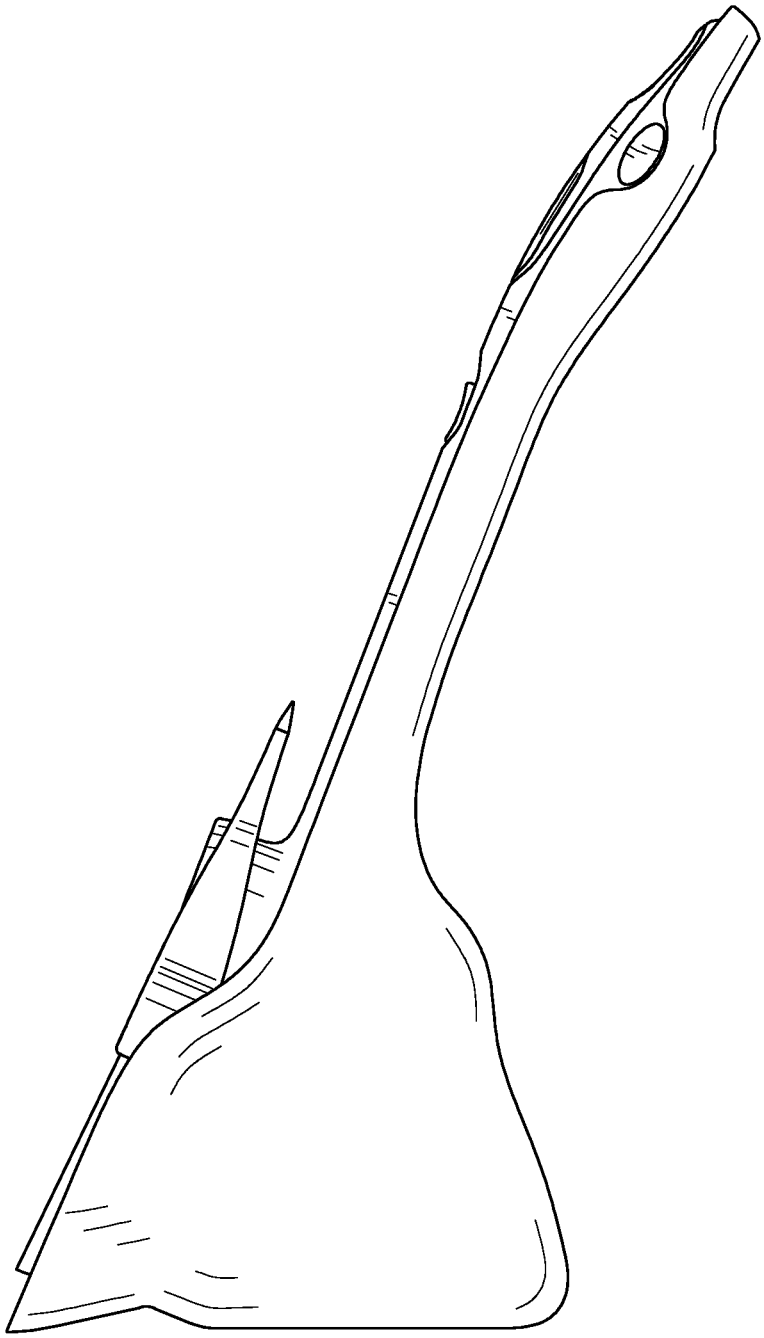
Figure 27:
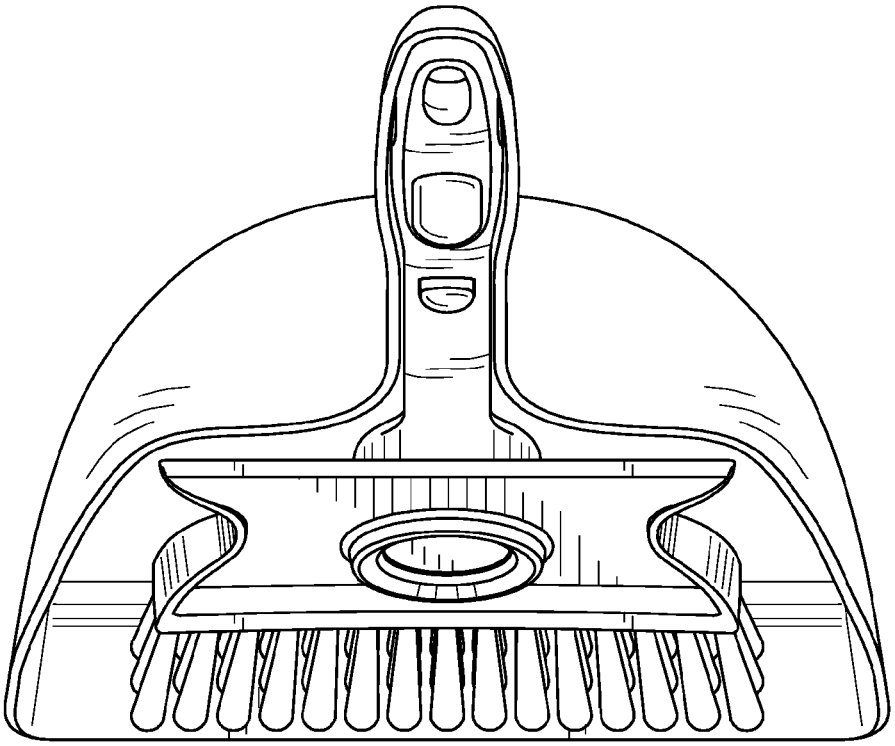
Figure 28:
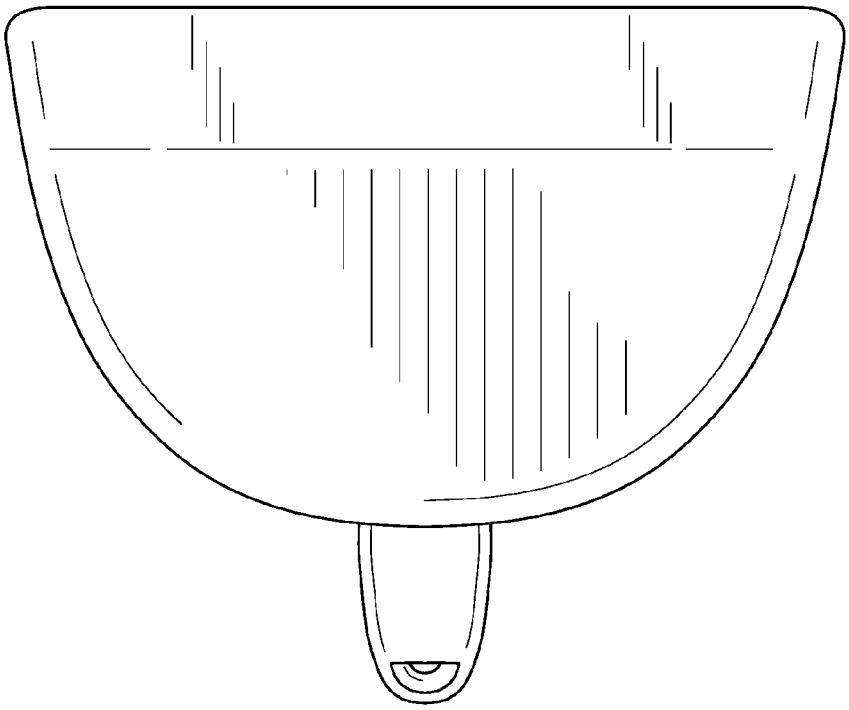

While the external appearance of combination device 200 is generally similar to that of device 100, combination device 200 illustrates an alternative coupling mechanism for rotatably coupling head 204 to handle 202. FIGS. 17-18 show exploded views of combination device 200, illustrating the coupling or connection mechanism between rotatable head 204 and a distal end of handle 202. FIG. 19 shows a close up view of the rearwardly extending coupling structures of the rotatable head 204 and the forwardly extending coupling structures at the bottom end of handle 202, while FIGS. 20A-20B show cross-sectional views through the coupling mechanism, both in a locked configuration (i.e., locked against rotation of head 204, shown in FIG. 20A) and an unlocked configuration (i.e., where rotation of head 204 is selectively permitted, shown in FIG. 20B).

As perhaps best seen in FIGS. 18 and 19, rotatable head 204 may include a rearwardly extending conical tapered cylinder 220. In other words, structure 220 may be a generally cylindrical shape, which tapers in diameter as a truncated cone towards its rearward end 221. Because of the conical taper, the diameter at rearward end 221 is less than the diameter where structure 220 emerges from the body of rotatable head 204. Cylinder 220 may include a plurality of alternating teeth 226 and recesses 232 formed into rearward end surface 221. The enlarged cylinder shape 228 disposed at the bottom end of handle 202 extends forwardly (opposed to the rearward extension of cylinder 220). Cylinder 228 may be configured to include correspondingly shaped structures to receive and mate with cylinder 220 of rotatable head 204.

As seen in FIG. 19, the interior of cylinder 228 may include an internal sidewall 224 defining an inner conical cylindrical socket 222 which corresponds to and mates with conical cylinder 220. Sidewall 224 may include a taper corresponding to that of conical tapered cylinder 220. While recess 122 of combination device 100 is fully open at its rearward end (see FIG. 8A), recess or socket 222 includes a rearward wall that closes off a portion of the rearward end of socket 222, although a central hole 223 is still provided. The forward (i.e., towards rotatable head 204) surface of rearward wall 262 may include radially extending ribs 264, which also extend forward from wall 262. Raised ribs 264 correspond to recesses 232 of cylinder 220, so that ribs 264 are received within recesses 232 when rotatable head 204 is coupled to handle 202.

Conical cylinder 220 and conical cylindrical socket 222 may advantageously include matching or corresponding shapes to fit together tightly. The conical tapered shape of each allows the components to fit together tightly, regardless of typical manufacturing tolerance deviations.

Wall 262 further includes tooth receiving portions 266, which mate with teeth 226, which are received therein. In the locked position (preventing rotation of head 204), the corresponding teeth 226 and portions 266; and recesses 232 and ribs 264 are sufficiently deeply engaged with one another to prevent rotation of cylinder 220 (and thus head 204) within cylindrical socket 222. In the unlocked position, there is a larger gap between such corresponding surfaces, allowing rotation of cylinder 220 within cylindrical socket 222. In other words, in such an unlocked position, teeth 226 are allowed to ride over ribs 264 during rotation to a desired head orientation. Once a desired orientation is achieved, the coupling mechanism may bias the mating structures towards one another again, returning to the locked position.

Elongate locking pin 234 may slide upwardly and downwardly, in a similar manner as locking pin 134 of combination device 100, although the distal end of locking pin 234 is somewhat differently configured, shown as including a forked distal end 236. A retainer plug 268 may be provided for coupling with forked distal end 236. Plug 268 may be biased (e.g., by a spring 270) away from a rear surface of wall 262, although fork 236, when locking pin 234 is in the downward locked position, presses plug 268 (compressing spring 270) towards the rear surface of wall 262. Because plug 268 is fastened (e.g., by screw 272) through plug 268, spring 270, through central hole 223, and into cap 230, such forward pressing movement results in corresponding movement of the entire coupling structure of handle 202 with respect to the coupling end surface 221 of cylinder 220 of rotatable head 204. In this forward pressed configuration, the rotatable head 204 is locked relative to handle 202.

Such force applications and movements are aided by a sufficient degree of flexibility and bendability within the parts themselves (e.g., locking pin 234, handle 202, etc.), which may be formed from a suitable plastic material, which is generally hard or rigid, but exhibits some ability to bend and flex, particularly in such elongate structures.

When locking pin 234 is advanced upward (e.g., against biasing provided by spring 240), less forward force is directed from fork 236 on plug 268 (even though some engagement between fork 236 and plug 268 may still be provided), and biasing spring 270 presses plug 268 (and the structures fastened thereto by screw 272) rearwardly, resulting in sufficient uncoupling of teeth 226 from portions 266; and ribs 264 from recess 232 to achieve the unlocked configuration, permitting rotation of head 204 (and cylinder 220) within socket 222 of handle 202. Once a desired rotated orientation is achieved, downward advancement of locking pin 234 (e.g., simply by releasing button 206) again locks teeth 226 into portions 266 and ribs 264 into recess 232. Spring 240 may bias locking pin 234 in a similar manner as described above relative to combination device 100, so that button 206 defaults to the locked, downward position seen in FIG. 16, and unlocking is achieved by the user actively pressing button 206 upwards, and holding it there as rotatable head 204 is rotated to the desired position. Release of button 206 then locks head into the selected position.

Cross-sectional views of FIGS. 20A-20B show the locked and unlocked positions, respectively. The relatively more forward position of cylinder 228 at the end of handle 202 (relative to head 204) is apparent in FIG. 20A as compared to FIG. 20B, as is the gap 276 between teeth 226 and portions 266 in FIG. 20B (unlocked), which gap is largely or completely eliminated in FIG. 20A (locked).

Locking pin 234 and handle 202 may include opposing wedges 278 and 280, respectively, which work with the spring 240 of locking pin 234 to place continuous locking or tightening force onto the structures (e.g., teeth 226) of rotatable head 204. Wedges 278 and 280 are perhaps best seen in FIG. 20C, as well as FIGS. 20A-20B. Wedge 278 may be disposed on a forward side of locking pin 234, above fork 236, and wedge 280 may be disposed on a rearward side of enlarged cylinder shape 228 of handle 202 (e.g., on a rearward surface of wall 262), at a location higher up (proximal) on handle 202 relative to ribs and portions 264 and 266, respectively. FIGS. 20A-20B show how the wedges 278 and 280 align and engage one another (FIG. 20A) when in the downward locked position. In the unlocked position, with locking pin 234 relatively higher within handle 202, wedge 278 is higher than wedge 280.

Such opposing wedges aid in providing the desired continual locking force (i.e., so that the rotatable head defaults to or is biased to a "locked" position), pulling cylinder 220 deeper into socket 222. As seen in FIGS. 20A-20B, the wedges 278 and 280 preferably are inclined from vertical, so as to provide such an increased pulling force. In an embodiment, wedge 278 includes an incline from 3° to 8° (e.g., about 5°) from vertical. Wedge 280 may include a corresponding incline from vertical so that the faces of the wedges slide over one another, wedge 280 pressing wedge 278 rearwardly as locking pin 234 advances further downward. Such rearward force on pin 234 through wedge 278 pulls cap 230 and cylinder 220 deeper into socket 222 (because of fastening screw 272 coupling plug 268 with cap 230). As described above, such force applications and movements are aided by an appropriate degree of flexibility and bendability within the parts themselves.

Figure 19A:
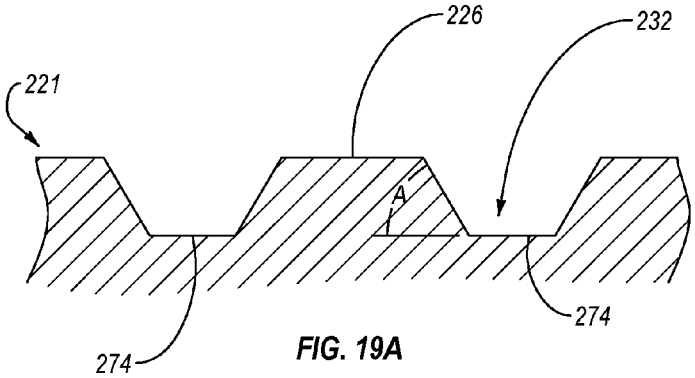
FIG. 19A shows a close up view the teeth and recesses formed in the end surface of the conical tapered cylinder of FIG. 19 of the rotatable head.

FIG. 19A illustrates a close up view of the geometry of exemplary teeth 226 and recesses 232 of conical tapered cylinder 220. As seen, in an embodiment, the transition between recesses 232 and an adjacent tooth 226 may not be through a sidewall that is perpendicular (90°) to the recess floor 274. Rather, the sides of teeth 226 may be inclined, e.g., at an angle A less than 90°, e.g., from 50° to 70° or 55° to 65° or about 60° relative to the floor of the adjacent recess 232. Stated another way, the preferred incline may be about 30° from vertical. Perpendicular tooth sides might provide for tighter locking, although the inventors have found that such an inclined side to the teeth provides a good balance between preventing unwanted unlocking of rotatable head 204, balanced against allowing rotation of the head 204, when the user intends to unlock head 204. As will be apparent from the above description, angles closer to perpendicular tooth sides (or even past perpendicular) result in ever tighter securement of the orientation of the head relative to the handle, but also make it more difficult to achieve unlocking and free rotation, where such is desired. A preferred configuration may include inclined sides to the teeth 226, as shown and described.

Stated another way, a width of a given recess 232 may be greater at end surface 221 (the open end of the recess) than the width of the recess at the floor 274 of the recess. The combination of wedges 278, 280 and the described inclined surfaces of teeth 226 have been found the inventors to provide for "slop free" use when sweeping or squeegeeing, while also permitting smooth rotational adjustment of the head, providing excellent balance between the desire to keep the head locked when intended, but to allow its rotation when a user wishes to selectively rotate the head to a different orientation. Such combination has been found to resist accidental unlocking of the rotatable head during use, when not intended.

If the incline of wedges 278, 280 is too steep, the user risks the locking pin being unintentionally bumped up (and unlocked) with forces applied simply during normal use. The particular combination of wedges, teeth, etc. has been found to advantageously tighten the locking mechanism during use, while still permitting selective unlocking where desired.

As with device 100, the coupling structure (e.g., teeth 226, recesses 232, ribs 264, portions 266) may be spaced apart from one another to provide for any desired lockable indexed increments of rotation. In the illustrated configuration, 8 of each structure are provided, each spaced 45° apart, permitting locking of head 204 at every 45°. Other configurations and spacings are of course also possible.

Another feature of combination device 200 may provide for magnetic coupling of handle 202 into dustpan handle 252. As described in conjunction with device 100 and dustpan 150, the device handle and the dustpan handle may be configured so that the handle of the combination device may be received and retained within the recess of the dustpan handle. Alternatively, or in addition to such feature, the handle 202 is shown as including one or more balls (e.g., ball magnets) or other-shaped inserts 282 disposed within corresponding receptacles 284. Each receptacle 284 may include a hole 286 through the rear surface of handle 202. As perhaps best seen in FIG. 21, the forward surface of handle 252 of dustpan 250 may include one or more corresponding forwardly protruding rivets 288. Rivets may be aligned and configured so as to be received into hole 286 as handle 202 is pressed into handle 252. The ball and/or rivet may be magnetic, so that the two are magnetically attracted to one another. For example, balls 282 may be magnetic, while rivets may comprise a metallic material (e.g., comprising iron or nickel, etc.) so as to be magnetically attracted thereto.

In an embodiment, movement of handle 202 into handle 252 creates an audible click sound when the handle 202 is pressed into handle 252 (as the magnetic attraction quickly pulls the two structures together over the last very small (e.g., 1 mm, 0.5 mm, etc.) distance, providing audible feedback to the user that the handle 202 has been properly stowed within dustpan handle 252.

In an embodiment, handle 202 may not technically be retained by the outer contours or shape of handle 252, but may simply be received therein. Retention may be provided rather by the magnetic coupling mechanism, and/or by handle 202 hanging on rivets 288 within holes 286. Thus, there may not technically be any snap-fit or press-fit between handles 202 and 252. In another embodiment, such a retention type fit (e.g., snap-fit and/or press-fit) could be provided.

Any features described in the context of a particular embodiment may be incorporated into another embodiment. For example, features described above in the context of combination device 100 and dustpan 150 may be incorporated into device 200 and dustpan 250 and vice versa.

Numbers, percentages, or other values stated herein are intended to include that value, and also other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing process, and may include values that are within 10%, within 5%, within 1%, etc. of a stated value. Furthermore, the terms "substantially", "about" or "approximately" as used herein represents an amount close to the stated amount that still performs a desired function or achieves a desired result. For example, the term "substantially" "about" or "approximately" may refer to an amount that is within 10% of, within 5% of, or within 1% of, a stated amount or value.

As used in this specification and the appended claims, the singular forms "a," "an" and "the" include plural referents unless the context clearly dictates otherwise.

The present invention can be embodied in other specific forms without departing from its spirit or essential characteristics. Thus, the described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A combination whisk broom and squeegee device comprising:

an elongate handle; and a rotatable head rotatably attached to the handle, the head including a broom end with a plurality of bristles at one end of the head, the head further including a squeegee end at an end opposite the whisk broom end such that the broom end may be used to sweep up dry spills and the squeegee end may be used to clean up wet spills;

wherein the head is rotatably coupled to the handle at a bottom portion of the handle by a coupling mechanism, the head being selectively rotatable and lockable in a desired orientation relative to the handle so as to orient the broom end or the squeegee end in a desired locked orientation for use thereof; and a release button disposed on or within the handle and coupled to the coupling mechanism of the head to the handle for selectively releasing and selectively locking the rotatable head in a desired orientation relative to the handle;

wherein the coupling mechanism between the head and the handle comprises a rearwardly extending conical tapered cylinder including a plurality of alternating teeth and recesses formed in an end surface of the conical tapered cylinder, the recesses mating with corresponding radially extending ribs disposed within a corresponding conical tapered cylindrical socket.

2. The combination whisk broom and squeegee as recited in claim 1, wherein the release button is configured to slide within the handle, a first position of the release button corresponding to the head being locked in a given orientation relative to the handle, while a second position of the release button corresponds to the head being freely rotatable about the coupling mechanism to the handle.

3. The combination whisk broom and squeegee as recited in claim 1, wherein the rearwardly extending conical tapered cylinder is on the head, and the corresponding conical tapered cylindrical socket is disposed within the distal end of the handle.

4. The combination whisk broom and squeegee as recited in claim 3, wherein the handle terminates at its bottom end in an enlarged cylinder shape, the cylinder extending forwardly, towards the head, the cylinder shape of the handle including the correspondingly shaped conical tapered cylindrical socket defined by a sidewall and including a central hole through a rearward wall defining a bottom of the socket, the central hole accepting a fastener for securing the enlarged cylinder shape at the bottom end of the handle to the rotatable head.

5. The combination whisk broom and squeegee as recited in claim 4, further comprising a cap that fits over an open front end of coupling structure of the head, into which the fastener is fastened.

6. The combination whisk broom and squeegee as recited in claim 4, wherein the release button is coupled to the coupling mechanism by an elongate locking pin which extends down the handle, a distal end of the locking pin including a forked end which engages a retainer plug that is biased away from a rear surface of the rearward wall at the bottom end of the handle, the locking pin being selectively advanceable downward to advance the retainer plug towards the rear surface of the rearward wall, locking the teeth and recesses in the end surface of the conical tapered cylinder of the rotatable head with the corresponding radially extending ribs disposed within the corresponding conical tapered cylindrical socket of the handle.

7. The combination whisk broom and squeegee as recited in claim 6, wherein the elongate locking pin is biased to the downward locked position.

8. The combination whisk broom and squeegee as recited in claim 6, wherein the elongate locking pin includes a wedge disposed on a forward side of the locking pin which engages with an oppositely disposed wedge disposed on a rearward side of the enlarged cylinder shape at the bottom end of the handle, the wedges of the locking pin and handle engaging one another when the locking pin is in the downward locked position.

9. The combination whisk broom and squeegee as recited in claim 8, wherein the wedge on the forward side of the locking pin includes an incline of from about 3° to about 8° relative to vertical, and the oppositely disposed wedge on the rearward side of the enlarged cylinder shape at the bottom end of the handle, includes a corresponding incline from about 3° to about 8° relative to vertical.

10. The combination whisk broom and squeegee as recited in claim 6, wherein the handle includes front and rear portions fastened together, wherein the locking pin is spring loaded within the handle so that the release button is biased to a position corresponding to one where the head is locked against rotation relative to the handle.

11. The combination whisk broom and squeegee as recited in claim 10, wherein a portion of the locking pin is manually accessible through a window cut-out in the front portion of the handle to selectively slide the locking pin upward to an unlocked position.

12. The combination whisk broom and squeegee as recited in claim 6, wherein the release button comprises a portion of the elongate locking pin, which together comprise a single piece of material.

13. The combination whisk broom and squeegee as recited in claim 3, wherein the teeth of the alternating teeth and recesses formed in the end surface of the conical tapered cylinder of the rotatable head include inclined sides between a given tooth and an adjacent recess, the inclined sides having an angle that is less than 90° relative to a floor of the adjacent recess.

14. The combination whisk broom and squeegee as recited in claim 13, wherein the inclined sides of the teeth have an angle that is from 50° to 70° relative to the floor of the adjacent recess.

15. The combination whisk broom and squeegee as recited in claim 3, wherein a width of each recess of the alternating teeth and recesses formed in the end surface of the conical tapered cylinder of the rotatable head is greater at the end surface of the conical tapered cylinder than a width of each recess at a floor of the recess.

16. The combination whisk broom and squeegee as recited in claim 3, wherein the alternating teeth and recesses formed in the end surface of the conical tapered cylinder of the rotatable head are spaced apart 45° between adjacent recesses.

17. The combination whisk broom and squeegee as recited in claim 1, further comprising a dustpan including a dustpan handle, the dustpan handle being hollow and correspondingly shaped and sized to receive the handle of the combination whisk broom and squeegee therein when the handle of the combination whisk broom and squeegee is pressed into the dustpan handle.

18. The combination whisk broom and squeegee as recited in claim 17, wherein the handle of the combination whisk broom and squeegee includes an insert disposed in a receptacle of the handle of the combination whisk broom and squeegee, the receptacle including a hole through a rear surface of the handle of the combination whisk broom and squeegee configured to receive a rivet disposed within a forward surface of the handle of the dustpan when the handle of the combination whisk broom and squeegee is inserted into the dustpan handle, the insert and rivet being magnetically attracted to one another.

19. The combination whisk broom and squeegee as recited in claim 18, wherein first contact between the insert and rivet creates an audible click when the handle of the combination whisk broom and squeegee device is pressed into the dustpan handle.

20. The combination whisk broom and squeegee as recited in claim 18, wherein the handle of the combination whisk broom and squeegee device hangs on the rivets of the dustpan handle.

* * * * *